US010975317B2

(12) United States Patent
Choi et al.

(10) Patent No.: US 10,975,317 B2
(45) Date of Patent: Apr. 13, 2021

(54) UPGRADING OF HEAVY OIL FOR STEAM CRACKING PROCESS

(71) Applicant: Saudi Arabian Oil Company, Dhahran (SA)

(72) Inventors: Ki-Hyouk Choi, Dhahran (SA); Mazin M. Fathi, Dhahran (SA); Muneef F. Alqarzouh, Dhahran (SA); Bandar K. Alotaibi, Dhahran (SA)

(73) Assignee: SAUDI ARABIAN OIL COMPANY

( * ) Notice: Subject to any disclaimer, the term of this patent is extended or adjusted under 35 U.S.C. 154(b) by 0 days.

(21) Appl. No.: 16/685,497

(22) Filed: Nov. 15, 2019

(65) Prior Publication Data

US 2020/0115644 A1 Apr. 16, 2020

Related U.S. Application Data

(62) Division of application No. 16/159,271, filed on Oct. 12, 2018, now Pat. No. 10,526,552.

(51) Int. Cl.
*C10G 69/04* (2006.01)
*C10G 55/06* (2006.01)

(52) U.S. Cl.
CPC ..... *C10G 69/04* (2013.01); *C10G 55/06* (2013.01); *C10G 2300/301* (2013.01);
(Continued)

(58) Field of Classification Search
CPC ..... C10G 69/04; C10G 69/06; C10G 55/04; C10G 55/06; C10G 2300/301;
(Continued)

(56) References Cited

U.S. PATENT DOCUMENTS 2,733,192 A 1/1956 Sage
2,880,171 A 3/1959 Flinn et al.
(Continued)

FOREIGN PATENT DOCUMENTS

CN 1508221 A 6/2004
CN 101553553 A 10/2009
(Continued)

OTHER PUBLICATIONS

"Alaska North Slope (Middle Pipeline)", Jan. 20, 2016, pp. 1-5 (Year: 2016).*
(Continued)

*Primary Examiner* — Youngsul Jeong
*Assistant Examiner* — Jason Y Chong
(74) *Attorney, Agent, or Firm* — Bracewell LLP; Constance R. Rhebergen

(57) ABSTRACT

A method for producing alkene gases from a cracked product effluent, the method comprising the steps of introducing the cracked product effluent to a fractionator unit, separating the cracked product effluent in the fractionator to produce a cracked light stream and a cracked residue stream, wherein the cracked light stream comprises the alkene gases selected from the group consisting of ethylene, propylene, butylene, and combinations of the same, mixing the cracked residue stream and the heavy feed in the heavy mixer to produce a combined supercritical process feed, and upgrading the combined supercritical process feed in the supercritical water process to produce a supercritical water process (SWP)-treated light product and a SWP-treated heavy product, wherein the SWP-treated heavy product comprises reduced amounts of olefins and asphaltenes relative to the cracked residue stream such that the SWP-treated heavy product exhibits increased stability relative to the cracked residue stream.

17 Claims, 5 Drawing Sheets

(52) U.S. Cl.
CPC . *C10G 2300/308* (2013.01); *C10G 2300/805* (2013.01); *C10G 2400/20* (2013.01)

(58) Field of Classification Search
CPC ..... C10G 2300/308; C10G 2300/805; C10G 2300/4081; C10G 2400/20; C10G 51/02; C10G 45/00; C10G 47/00; C10G 31/08; C10G 9/36
See application file for complete search history.

(56) References Cited

U.S. PATENT DOCUMENTS 2,944,012 A 7/1960 Thompson
2,967,204 A 1/1961 Beuther et al.
3,116,234 A 12/1963 Douwes et al.
3,501,396 A 3/1970 Gatsis
3,576,596 A 4/1971 Kranc et al.
3,586,621 A 6/1971 Pitchford et al.
3,654,139 A 4/1972 Winsor et al.
3,690,706 A 9/1972 Boik et al.
3,702,292 A 11/1972 Burich
3,708,421 A 1/1973 Rippie
3,733,259 A 5/1973 Wilson et al.
3,830,752 A 8/1974 Mickelson
3,842,014 A 10/1974 Friend et al.
3,864,451 A 2/1975 Lee et al.
3,898,299 A 8/1975 Jones
3,948,754 A 4/1976 McCollum et al.
3,948,755 A 4/1976 McCollum et al.
3,960,706 A 6/1976 McCollum et al.
3,960,708 A 6/1976 McCollum et al.
3,988,238 A 10/1976 McCollum et al.
3,989,618 A 11/1976 McCollum et al.
4,005,005 A 1/1977 McCollum et al.
4,082,695 A 4/1978 Rosinski et al.
4,151,068 A 4/1979 McCollum et al.
4,203,829 A 5/1980 Bertolacini
4,210,628 A 7/1980 Ninomiya et al.
4,325,926 A 4/1982 Blanton, Jr.
4,464,252 A 8/1984 Eberly, Jr. et al.
4,483,761 A 11/1984 Paspek, Jr.
4,485,007 A 11/1984 Tam et al.
4,530,755 A 7/1985 Ritchie et al.
4,544,481 A 10/1985 Seiver et al.
4,571,295 A 2/1986 Forte
4,594,141 A 6/1986 Paspek, Jr. et al.
4,719,000 A 1/1988 Beckberger
4,743,357 A 5/1988 Patel et al.
4,762,814 A 8/1988 Parrott et al.
4,818,370 A 4/1989 Gregoli et al.
4,822,497 A 4/1989 Hong et al.
4,840,725 A 6/1989 Paspek
4,908,122 A 3/1990 Frame et al.
5,087,350 A 2/1992 Paris-Marcano
5,096,567 A 3/1992 Paspek et al.
5,167,797 A 12/1992 Ou
5,278,138 A 1/1994 Ott et al.
5,316,659 A 5/1994 Brons et al.
5,411,658 A 5/1995 Chawla et al.
5,421,854 A 6/1995 Kodas et al.
5,439,502 A 8/1995 Kodas et al.
5,466,363 A 11/1995 Audeh et al.
5,496,464 A 3/1996 Piskorz et al.
5,529,968 A 6/1996 Sudhakar et al.
5,538,930 A 7/1996 Sudhakar et al.
5,558,783 A 9/1996 McGuinness
5,560,823 A 10/1996 Whiting
5,597,476 A 1/1997 Hearn et al.
5,611,915 A 3/1997 Siskin et al.
5,616,165 A 4/1997 Glicksman et al.
5,626,742 A 5/1997 Brons et al.
5,676,822 A 10/1997 Sudhakar
5,695,632 A 12/1997 Brons et al.
5,837,640 A 11/1998 Sudhakar et al.
5,851,381 A 12/1998 Tanaka et al.
5,861,136 A 1/1999 Glicksman
5,906,730 A 5/1999 Hatanaka et al.
5,928,497 A 7/1999 Iaccino
5,958,224 A 9/1999 Ho et al.
5,990,370 A * 11/1999 Sims ..... C07C 4/04 585/302
6,063,265 A 5/2000 Chiyoda et al.
6,096,194 A 8/2000 Tsybulevskiy et al.
6,103,393 A 8/2000 Kodas et al.
6,120,679 A 9/2000 Hatanaka et al.
6,153,123 A 11/2000 Hampden-Smith et al.
6,159,267 A 12/2000 Hampden-Smith et al.
6,197,718 B1 3/2001 Brignac et al.
6,228,254 B1 5/2001 Jossens et al.
6,248,230 B1 6/2001 Min et al.
6,277,271 B1 8/2001 Kocal
6,303,020 B1 10/2001 Podrebarac et al.
6,316,100 B1 11/2001 Kodas et al.
6,325,921 B1 12/2001 Andersen
6,334,948 B1 1/2002 Didillon et al.
6,488,840 B1 12/2002 Greaney et al.
6,500,219 B1 12/2002 Gunnerman
6,551,501 B1 4/2003 Whitehurst et al.
6,579,444 B2 6/2003 Feimer et al.
6,596,157 B2 7/2003 Gupta et al.
6,610,197 B2 8/2003 Stuntz et al.
6,623,627 B1 9/2003 Zhou
6,685,762 B1 2/2004 Brewster et al.
6,689,186 B1 2/2004 Hampden-Smith et al.
6,699,304 B1 3/2004 Hampden-Smith et al.
6,780,350 B1 8/2004 Kodas et al.
6,827,845 B2 12/2004 Gong et al.
6,881,325 B2 4/2005 Morris et al.
7,144,498 B2 12/2006 McCall et al.
7,264,710 B2 9/2007 Hokari et al.
7,435,330 B2 10/2008 Hokari et al.
7,731,837 B2 6/2010 Song et al.
7,754,067 B2 7/2010 Allam
7,780,847 B2 8/2010 Choi
7,842,181 B2 11/2010 Choi
7,922,895 B2 4/2011 Banerjee
8,367,425 B1 2/2013 Schabron et al.
8,399,729 B2 3/2013 Davis
8,496,786 B2 7/2013 Larson
8,648,224 B2 2/2014 Vermeiren
8,696,888 B2 4/2014 Keusenkothen
8,784,743 B2 7/2014 Keusenkothen et al.
9,290,706 B2 3/2016 Zhao
9,505,678 B2 11/2016 Choi et al.
9,567,530 B2 2/2017 Choi
9,656,230 B2 5/2017 Choi
9,670,419 B2 6/2017 Choi
9,777,566 B2 10/2017 Matzakos
2002/0086150 A1 7/2002 Hazlebeck
2002/0162332 A1 11/2002 Hazlebeck
2003/0062163 A1 4/2003 Moulton et al.
2003/0217952 A1 11/2003 Brignac et al.
2004/0007506 A1 1/2004 Song et al.
2004/0024072 A1 2/2004 Lin et al.
2004/0118748 A1 6/2004 Lesemann et al.
2004/0178123 A1 9/2004 Podrebarac
2004/0188327 A1 9/2004 Groten
2004/0232046 A1 11/2004 Tanaka et al.
2005/0040078 A1 2/2005 Zinnen et al.
2005/0040081 A1 2/2005 Takahashi et al.
2005/0067323 A1 3/2005 Balko
2005/0072137 A1 4/2005 Hokari et al.
2005/0075528 A1 4/2005 Burkhardt et al.
2005/0098478 A1 5/2005 Gupta et al.
2005/0167333 A1 8/2005 McCall et al.
2005/0173297 A1 8/2005 Toida
2005/0252831 A1 11/2005 Dysard et al.
2005/0284794 A1 12/2005 Davis et al.
2006/0011511 A1 1/2006 Hokari et al.
2006/0043001 A1 3/2006 Weston et al.
2006/0151359 A1 7/2006 Ellis et al.
2006/0154814 A1 7/2006 Zanibelli et al.
2006/0163117 A1 7/2006 Hong
2007/0056881 A1 3/2007 Berkowitz et al.

(56) References Cited

U.S. PATENT DOCUMENTS

| | | | | |
|---|---|---|---|---|
| 2007/0090021 | A1 | 4/2007 | McCall et al. | |
| 2007/0111319 | A1 | 5/2007 | Bastide et al. | |
| 2007/0227950 | A1 | 10/2007 | Martinie et al. | |
| 2007/0234640 | A1 | 10/2007 | Jia et al. | |
| 2007/0289898 | A1 | 12/2007 | Banerjee | |
| 2008/0099373 | A1 | 5/2008 | Hokari et al. | |
| 2008/0099374 | A1 | 5/2008 | He et al. | |
| 2008/0099375 | A1 | 5/2008 | Landau et al. | |
| 2008/0099376 | A1 | 5/2008 | He et al. | |
| 2008/0099377 | A1 | 5/2008 | He et al. | |
| 2009/0032436 | A1 | 2/2009 | Takahashi et al. | |
| 2009/0139715 | A1 | 6/2009 | Choi | |
| 2009/0145808 | A1 | 6/2009 | Choi et al. | |
| 2009/0148374 | A1 | 6/2009 | Choi | |
| 2009/0159498 | A1 | 6/2009 | Chinn et al. | |
| 2009/0159504 | A1 | 6/2009 | Choi et al. | |
| 2009/0166261 | A1 | 7/2009 | Li et al. | |
| 2009/0166262 | A1 | 7/2009 | He et al. | |
| 2009/0206006 | A1 | 8/2009 | Allam | |
| 2009/0206007 | A1 | 8/2009 | Allam | |
| 2009/0230026 | A1 | 9/2009 | Choi et al. | |
| 2009/0314683 | A1 | 12/2009 | Matsushita | |
| 2010/0189610 | A1 | 7/2010 | Allam | |
| 2010/0314583 | A1 | 12/2010 | Banerjee | |
| 2011/0024330 | A1 | 2/2011 | Choi | |
| 2011/0147266 | A1 | 6/2011 | Choi | |
| 2011/0163011 | A1 | 7/2011 | Yarbro | |
| 2011/0198085 | A1 | 8/2011 | O'Brian | |
| 2011/0266115 | A1 | 11/2011 | Berkowitz et al. | |
| 2011/0297506 | A1 | 12/2011 | Choi et al. | |
| 2011/0315600 | A1 | 12/2011 | Choi et al. | |
| 2012/0000819 | A1 | 1/2012 | Matsushita | |
| 2012/0060418 | A1 | 3/2012 | Epstein et al. | |
| 2012/0061291 | A1 | 3/2012 | Choi et al. | |
| 2012/0061294 | A1 | 3/2012 | Choi et al. | |
| 2012/0132566 | A1 | 5/2012 | Janssen et al. | |
| 2012/0138510 | A1 | 6/2012 | Choi et al. | |
| 2012/0181217 | A1 | 7/2012 | Choi et al. | |
| 2013/0140214 | A1 | 6/2013 | Choi | |
| 2013/0180888 | A1* | 7/2013 | Corscadden ..... | C10G 21/003 208/309 |
| 2013/0233766 | A1* | 9/2013 | Shafi ..... | C10G 45/00 208/61 |
| 2013/0267745 | A1 | 10/2013 | Schrod | |
| 2014/0054198 | A1* | 2/2014 | Podrebarac ..... | C10G 65/00 208/57 |
| 2014/0109465 | A1 | 4/2014 | Coppola et al. | |
| 2014/0353138 | A1 | 12/2014 | Amale et al. | |
| 2015/0090631 | A1* | 4/2015 | Joo ..... | G01N 33/28 208/14 |
| 2015/0321945 | A1 | 11/2015 | Okada | |
| 2015/0321975 | A1 | 11/2015 | Choi et al. | |
| 2015/0376512 | A1 | 12/2015 | Lourenco | |
| 2017/0107433 | A1 | 4/2017 | Choi | |
| 2017/0166821 | A1 | 6/2017 | Choi | |
| 2017/0166824 | A1 | 6/2017 | Choi | |
| 2018/0265792 | A1 | 9/2018 | Choi et al. | |

FOREIGN PATENT DOCUMENTS

| | | | |
|---|---|---|---|
| EP | 0199555 | A2 | 10/1986 |
| EP | 0341893 | A2 | 11/1989 |
| EP | 1454976 | A1 | 9/2004 |
| EP | 1537912 | A1 | 6/2005 |
| EP | 1577007 | A1 | 9/2005 |
| EP | 1923452 | A1 | 5/2008 |
| JP | 07265689 | A | 10/1995 |
| WO | 20090073446 | A2 | 6/2009 |
| WO | 20110132056 | A2 | 10/2011 |
| WO | 20130066852 | A2 | 5/2013 |

OTHER PUBLICATIONS

Adschiri et al., "Catalytic Hydrodesulfurization of Dibenzothiophene through Partial Oxidation and Water-Gas Shift Reaction in Supercritical Water", published in Ind. Eng. Chem. Res., vol. 37, pp. 2634-2638, (1998).

Adschiri et al., "Hydrogenation through Partial Oxidation of Hydrocarbon in Supercritical Water", published in Int. J. of The Soc. Of Mat. Eng. For Resources, vol. 7, No. 2, pp. 273-281, (1999).

Amemiya et al., "Catalyst Deactivation in Distillate Hydrotreating (Part 2) Raman Analysis of Carbon Deposited on Hydrotreating Catalyst for Vacuum Gas Oil", Journal of the Japan Petroleum Institute (2003), pp. 99-104, vol. 46, No. 2.

Amestica and Wolf, "Catalytic Liquefaction of Coal With Supercritical Water/CO/Solvent Media", XP-002663069, Fuel, Sep. 30, 1986, pp. 1226-1332, vol. 65, Butterworth & Co. (1986).

Arturo J. Hernandez and Ralph T. Yang, "Desulfurization of Transportation Fuels by Adsorption", Catalysis Reviews (2004), pp. 111-150, vol. 46, No. 2.

Chica et al., "Catalytic oxidative desulfurization (ODS) of diesel fuel on a continuous fixed-bed reactor", Journal of Catalysis, vol. 242, (2006), pp. 299-308.

Choi et al., "Facile ultra-deep desulfurization of gas oil through two-stage or layer catalyst bed", Catalysis Today (2003), vol. 86, pp. 277-286.

Choi et al., Impact of removal extent of nitrogen species in gas oil on its HDS performance: an efficient approach to its ultra deep desulfurization:, Applied Catalysis B: Environmental (2004), vol. 50, pp. 9-16.

Choi et al., "Preparation and Characterization on nano-sized CoMo/A12o3 catalyst for hydrodesulfurization", Applied Catalysis A: General 260 (2004) 229-236.

Choi et al., "Preparation of CO2 Absorbent by Spray Pyrolysis", Chemistry Letters, vol. 32, No. 10 (2003), pp. 924-925.

De Filippis et al., "Oxidation Desulfurization: Oxidation Reactivity of Sulfur Compounds in Different Organic Matrixes", Energy & Fuels, vol. 17, No. 6 (2003), pp. 1452-1455.

Farag et al., "Carbon versus alumina as a support for Co—Mo catalysts reactivity towards HDS of dibenzothiophenes and diesel fuel", Catalysis Today 50 (1999) 9-17.

Fathi, et al., "Catalytic Aquaproessing of Arab Light Vacuum Residue via Short Space Times", Energy & Fuels, 25, 4867-4877(2011).

Furimsky et al., "Deactivation of hydroprocessing catalyst", Catalysis Today (1999), pp. 381-495, vol. 52.

Gao et al., "Adsorption and reduction of NO2 over activated carbon at low temperature", Fuel Processing Technology 92, 2011, pp. 139-146, Elsevier B.V.

Gray, et al., "Role of Chain Reactions and Olefin Formation in Cracking, Hydroconversion, and Coking of Petroleum and Bitumen Fractions", Energy & Fuels, 16, 756-766(2002).

International Search Report and Written Opinion for related PCT application PCT/US2019/055801 dated Jan. 24, 2020. (SA5950PCT).

J.G. Speight, "Visbreaking: A technology of the past and the future", Scientia Iranica, vol. 19, Issue 3, Jun. 2012, pp. 569-573.

J.G. Speight, "Handbook of Industrial Hydrocarbon Processes", Elsevier, 2011, Chapter 11, ISBN 978-0-7506-8632-7, pp. 395-406.

Kniel, et al., "Ethylene; Keystone to the Petrochemical Industry", Marcel Dekker, New York(NY), 1980, pp. 62-72. ISBN 0-8247-6914-7.

Mochida et al., "Kinetic study of the continuous removal of Sox on polyacrylonitrile-based activated carbon fibers", Fuel, vol. 76, No. 6 (1997), pp. 533-536.

Mochida et al., "Removal of Sox and Nox over activated carbon fibers", Carbon, vol. 38 (2000), pp. 227-239.

PCT/US2018/022301 International Search Report and Written Opinion dated May 22, 2018; 14 pgs (SA5563PCT).

Perry's Chemical Engineers' Handbook,Eighth Ed., 2008, McGraw-Hill, pp. 10-24-10-27.

Pinero et al., "Temperature programmed desorption study on the mechanism of SO2 oxidation by activated carbon and activated carbon fibers", Carbon, vol. 39 (2001), pp. 231-242.

Sampanthar et al., "A novel oxidative desulfurization process to remove refractory sulfur compounds from diesel fuel", Applied Catalysis B: Environmental 63 (2006), pp. 85-93.

(56) References Cited

OTHER PUBLICATIONS

Totten, "Fuels and Lubricants Handbook—Technology, Properties, Performance, and Testing", ASTM International, 2003, pp. 23.
Broach et al., "Zeolites", Ullmann's Encyclopedia of Industrial Chemistry, Apr. 15, 2012, pp. 1-35.
Jinli Zhang et. al., "The effect of supercritical water on coal pyrolysis and hydrogen production: A combined ReaxFF and DFT study", Fuel, 108, 682-690 (2013).
Heinz Zimmermann and Roland Walzl, "Ethylene", Ullmann Encyclopedia of Industrial Chemistry, Wiley-VCH Verlag, 2012, vol. 13, pp. 465.

* cited by examiner

UPGRADING OF HEAVY OIL FOR STEAM CRACKING PROCESS

CROSS-REFERENCE TO RELATED APPLICATIONS

This patent application is a divisional of U.S. Non-Provisional patent application Ser. No. 16/159,271 filed on Oct. 12, 2018. For purposes of United States patent practice, the non-provisional application is incorporated by reference in its entirety.

TECHNICAL FIELD

Disclosed are methods for upgrading petroleum. Specifically, disclosed are methods and systems for upgrading petroleum using pretreatment processes.

BACKGROUND

Chemical production is a primary consumer of crude oil. Traditionally, straight run naphtha (naphtha being a mixture of hydrocarbons having boiling points less than 200 degrees Celsius (deg C.)) can be used for steam cracking to produce ethylene and propylene, because straight run naphtha contains a greater hydrogen content relative to other feedstocks. In addition, straight run naphtha typically produces limited amounts of hydrocarbons containing more than 10 carbon atoms, also called pyrolysis fuel oil, on the order of 3 weight percent (wt %) to 6 wt % of the total product. Heavier feedstocks, such as vacuum gas oil, can be processed in a fluid catalytic cracking (FCC) unit to produce propylene and ethylene. While an FCC unit can result in the production of high octane-rating gasoline blend stock, it is limited in conversion of feedstock into ethylene and propylene.

Other feedstocks, such as gas oil with a boiling point of greater than 200 deg C., can be used in steam cracking processes, but can result in a lower yield of ethylene and propylene, as well as an increased coking rate due to the heavy molecules in the gas oil fraction. Thus, gas oil fractions do not make suitable feeds for steam cracking processes.

Expanding feedstocks for steam cracking processes to include whole range crude oil or residue fractions is problematic because of the presence of large molecules such as asphaltene in the feedstock. Heavy molecules, particularly, polyaromatic compounds, tend to form coke in the pyrolysis tube and cause fouling in the transfer line exchanger (TLE). A coke layer in the pyrolysis tube can inhibit heat transfer and can cause physical failure of the pyrolysis tube. Severe coking can shorten the run time of the steam cracker, which is one of the most critical parameters in managing the economics of a steam cracker. As a result, the advantage of using cheaper feedstocks, crude oil and heavy residue streams, can be depleted by a short run length of the steam cracking plant. It should be noted that when starting with whole range crude oil or residue fractions the amount of pyrolysis fuel oil can be between 20 wt % and 30 wt % of the total product stream.

Gas oil fractions can be pre-treated in one or more pre-treatment approaches, such as hydrotreatment processes, thermal conversion processes, extraction processes, and distillation processes. Thermal conversion processes can include coking processes and visbreaking processes. Extraction processes can include solvent deasphalting processes. Distillation processes can include atmospheric distillation or vacuum distillation processes. The pre-treatment approaches can decrease the heavy residue fractions, such as the atmospheric residue fraction and the vacuum residue fractions. Thus, decreasing the heavy residue fractions in the feed to the steam cracking feedstock can improve the efficiency of the steam cracking feedstock.

These pre-treatment approaches can process the whole range crude oil before introducing the pre-treated process to the steam cracking process. The pre-treatment approaches can increase light olefin yield and reduce coking in a steam cracking processes. The pre-treatment approaches can increase the hydrogen content of the steam cracking feed—hydrogen content is related to light olefin yield such that the greater the hydrogen content the greater the light olefin yield.

The pre-treatment approaches can decrease the content of heteroatoms, such as sulfur and metals. Sulfur compounds can suppress carbon monoxide formation in a steam cracking process by passivating an inner surface of the pyrolysis tubes. In one approach, 20 wt ppm dimethyl sulfide can be added to a sulfur-free feedstock. However, sulfur content greater than 400 wt ppm in the feedstock to a steam crack process can increase the coking rate in the pyrolysis tubes.

While the pre-treatment approaches can increase the efficiency of a steam cracking process, the pre-treatment approaches also have several drawbacks. First, a hydrotreating process can require a large capital investment and does not remove all undesired compounds, such as asphaltenes. Second, the use of a pre-treatment approach, such as coking, extraction, and distillation, can result in low liquid yield for the feed to the steam cracking process because an amount of the feed is rejected as residue. Third, pre-treatment approaches can require extensive maintenance due to deactivation of catalyst caused by coking, asphaltene deposition, catalyst poisoning, fouling, and sintering of the active species. Finally, many of the pre-treatment processes reject the heaviest fractions of the streams, which reduces overall yield of light olefins and impacts a parameter influence economics of the steam cracker.

SUMMARY

Disclosed are methods for upgrading petroleum. Specifically, disclosed are methods and systems for upgrading petroleum using pretreatment processes.

In a first aspect, a method for producing alkene gases from a cracked product effluent is provided. The method includes the steps of introducing the cracked product effluent to a fractionator unit, the fractionator unit configured to separate the cracked product effluent, separating the cracked product effluent in the fractionator to produce a cracked light stream and a cracked residue stream, where the cracked light stream includes the alkene gases, where the alkene gases are selected from the group consisting of ethylene, propylene, butylene, and combinations of the same, introducing the cracked residue stream and a heavy feed to a heavy mixer, mixing the cracked residue stream and the heavy feed in the heavy mixer to produce a combined supercritical process feed, introducing the combined supercritical process feed and a water feed to a supercritical water process, the supercritical water process configured to upgrade the combined supercritical process feed, and upgrading the combined supercritical process feed in the supercritical water process to produce a supercritical water process (SWP)-treated light product and a SWP-treated heavy product, where the SWP-treated heavy product includes reduced amounts of olefins and asphaltenes relative to the cracked residue stream such that the SWP-treated heavy product exhibits increased stability relative to the cracked residue stream.

In certain aspects the method further includes the steps of introducing a crude oil feed and a hydrogen feed to a hydrogen addition process, the hydrogen addition process configured to facilitate hydrogenation of hydrocarbons in the crude oil feed, where the hydrogen addition process includes a hydrogenation catalyst, where the hydrogenation catalyst is operable to catalyze hydrotreating reactions, allowing the hydrocarbons in the crude oil feed to undergo the hydrotreating reactions in the hydrogen addition process to produce a hydrogen-added stream, where the hydrogen-added stream includes paraffins, naphthenes, aromatics, light gases, and combinations of the same, introducing the hydrogen-added stream to a separator unit, the separator unit configured to separate the hydrogen-added stream, separating the hydrogen-added stream in the separator unit to produce a light feed and the heavy feed, where the light feed includes hydrocarbons with boiling points of less than 650 deg. F., where the heavy feed includes hydrocarbons with boiling points of greater than 650 deg. F., introducing the light feed and the SWP-treated light product to a light mixer, mixing the light feed with the SWP-treated light product in the light mixer to produce a combined steam cracking feed, introducing the combined steam cracking feed to a steam cracking process, the steam cracking process configured to thermally crack the combined steam cracking feed in the presence of steam, and allowing thermal cracking to occur in the steam cracking process to produce the cracked product effluent.

In certain aspects the method further includes the steps of introducing a crude oil feed and a hydrogen feed to a hydrogen addition process, the hydrogen addition process configured to facilitate hydrogenation of hydrocarbons in the crude oil feed, where the hydrogen addition process includes a hydrogenation catalyst, where the hydrogenation catalyst is operable to catalyze hydrotreating reactions, allowing the hydrocarbons in the crude oil feed to undergo the hydrotreating reactions in the hydrogen addition process to produce a hydrogen-added stream, where the hydrogen-added stream includes paraffins, naphthenes, aromatics, and light gases, introducing the hydrogen-added stream and the SWP-treated light product to a feed mixer, mixing the light feed with the SWP-treated light product in the feed mixer to produce a combined separator feed, introducing the combined separator feed to a separator unit, the separator unit configured to separate the combined separator feed, separating the combined separator feed in the separator unit to produce a light feed and the heavy feed, where the light feed includes hydrocarbons with boiling points of less than 650 deg. F., where the heavy feed includes hydrocarbons with boiling points of greater than 650 deg. F., introducing the light feed to a steam cracking process, the steam cracking process configured to thermally crack the light feed in the presence of steam, and allowing thermal cracking to occur in the steam cracking process to produce the cracked product effluent.

In certain aspects the method further includes the steps of separating light gases from the cracked product effluent in the fractionator unit to produce a recovered hydrogen stream, where the recovered hydrogen stream includes hydrogen, and introducing the recovered hydrogen stream to the heavy mixer, such that the combined supercritical water feed includes hydrogen.

In certain aspects, an API gravity of the crude oil feed is between 15 and 50, where an atmospheric fraction of the crude oil feed is between 10 vol % and 60 vol %, where a vacuum fraction is between 1 vol % and 35 vol %, where an asphaltene fraction is between 0.1 wt % and 15 wt %, and where a total sulfur content is between 2.5 vol % and 26 vol %. In certain aspects, the hydrogenation catalyst includes a transition metal sulfide supported on an oxide support, where the transition metal sulfide is selected from the group consisting of cobalt-molybdenum sulfide (CoMoS), nickel-molybdenum sulfide (NiMoS), nickel-tungsten sulfide (NiWS) and combinations of the same. In certain aspects, the hydrotreating reactions are selected from the group consisting of hydrogenation reactions, hydrogenative dissociation reactions, hydrogenative cracking reactions, isomerization reactions, alkylation reactions, upgrading reactions, and combinations of the same. In certain aspects, the cracked residue stream includes hydrocarbons having a boiling point greater than 200 deg C.

In a second aspect, a method for producing alkene gases from a cracked product effluent is provided, the method includes the steps of introducing the cracked product effluent to a fractionator unit, the fractionator unit configured to separate the cracked product effluent, separating the cracked product effluent in the fractionator to produce a cracked light stream and a cracked residue stream, where the cracked light stream includes the alkene gases, where the alkene gases are selected from the group consisting of ethylene, propylene, butylene, and combinations of the same, introducing the cracked residue stream and a distillate residue stream to a heavy mixer, mixing the cracked residue stream and the distillate residue stream in the heavy mixer to produce a combined residue stream, introducing the combined residue stream and a water feed to a supercritical water process, the supercritical water process configured to upgrade the combined residue stream, and upgrading the combined residue stream in the supercritical water process to produce a supercritical water process (SWP)-treated light product and a SWP-treated heavy product, where the SWP-treated heavy product includes reduced amounts of olefins and asphaltenes relative to the cracked residue stream such that the SWP-treated heavy product exhibits increased stability relative to the cracked residue stream.

In certain aspects, the method further includes the steps of introducing a crude oil feed to a distillation unit, the distillation unit configured to separate the crude oil feed, separating the crude oil feed in the distillation unit to produce a distillate stream and the distillate residue stream, where the distillate stream includes hydrocarbons with boiling points less than 650 deg. F., introducing the distillate stream to a hydrogen addition process, the hydrogen addition process configured to facilitate hydrogenation of hydrocarbons in the distillate stream, where the hydrogen addition process includes a hydrogenation catalyst, where the hydrogenation catalyst is operable to catalyze hydrotreating reactions, allowing the hydrocarbons in the distillate stream to undergo the hydrotreating reactions in the hydrogen addition process to produce a hydrogen-added stream, where the hydrogen-added stream includes paraffins, naphthenes, aromatics, light gases, and combinations of the same, introducing the hydrogen-added stream and the SWP-treated light product to a feed mixer, mixing the hydrogen-added stream with the SWP-treated light product in the feed mixer to produce a combined separator feed, introducing the combined separator feed to a steam cracking process, the steam cracking process configured to thermally crack the combined separator feed in the presence of steam, and allowing thermal cracking to occur in the steam cracking process to produce the cracked product effluent.

In certain aspects the method further includes the steps of introducing a crude oil feed to a distillation unit, the distillation unit configured to separate the crude oil feed, separating the crude oil feed in the distillation unit to produce a distillate stream and the distillate residue stream, where the distillate stream includes hydrocarbons with boiling points less than 650 deg. F., introducing the distillate stream and the SWP-treated light product to a distillate mixer, mixing the distillate stream with the SWP-treated light product in the distillate mixer to produce a combined distillate stream, introducing the combined distillate stream to a hydrogen addition process, the hydrogen addition process configured to facilitate hydrogenation of hydrocarbons in the combined distillate stream, where the hydrogen addition process includes a hydrogenation catalyst, where the hydrogenation catalyst is operable to catalyze hydrotreating reactions, allowing the hydrocarbons in the combined distillate stream to undergo the hydrotreating reactions in the hydrogen addition process to produce a hydrogen-added stream, where the hydrogen-added stream includes paraffins, naphthenes, aromatics, light gases, and combinations of the same, introducing the hydrogen-added stream to a steam cracking process, the steam cracking process configured to thermally crack the hydrogen-added stream in the presence of steam, and allowing thermal cracking to occur in the steam cracking process to produce the cracked product effluent.

In a third aspect, a method for producing alkene gases from a cracked product effluent is provided. The method includes the steps of introducing the cracked product effluent to a fractionator unit, the fractionator unit configured to separate the cracked product effluent, separating the cracked product effluent in the fractionator to produce a cracked light stream and a cracked residue stream, where the cracked light stream includes the alkene gases, where the alkene gases are selected from the group consisting of ethylene, propylene, butylene, and combinations of the same, introducing the cracked residue stream and a hydrogen-added stream to a heavy mixer, mixing the cracked residue stream and the hydrogen-added stream in the heavy mixer to produce a mixed stream, introducing the mixed stream and a water feed to a supercritical water process, the supercritical water process configured to upgrade the mixed stream, and upgrading the mixed stream in the supercritical water process to produce a supercritical water process (SWP)-treated light product and a SWP-treated heavy product, where the SWP-treated heavy product includes reduced amounts of olefins and asphaltenes relative to the cracked residue stream such that the SWP-treated heavy product exhibits increased stability relative to the cracked residue stream.

In certain aspect, the method further includes the steps of introducing a crude oil feed to a distillation unit, the distillation unit configured to separate the crude oil feed, separating the crude oil feed in the distillation unit to produce a distillate stream and a distillate residue stream, where the distillate stream includes hydrocarbons with boiling points of less than 650 deg. F., introducing the distillate stream and the SWP-treated light product to a distillate mixer, mixing the distillate stream with the SWP-treated light product in the distillate mixer to produce a combined distillate stream, introducing the combined distillate stream to a steam cracking process, the steam cracking process configured to thermally crack the combined distillate stream in the presence of steam, allowing thermal cracking to occur in the steam cracking process to produce the cracked product effluent, introducing the distillate residue stream to a hydrogen addition process, the hydrogen addition process configured to facilitate hydrogenation of hydrocarbons in the distillate residue stream, where the hydrogen addition process includes a hydrogenation catalyst, where the hydrogenation catalyst is operable to catalyze hydrotreating reactions, and allowing the hydrocarbons in the distillate residue stream to undergo the hydrotreating reactions in the hydrogen addition process to produce the hydrogen-added stream, where the hydrogen-added stream includes paraffins, naphthenes, aromatics, light gases, and combinations of the same.

BRIEF DESCRIPTION OF THE DRAWINGS

These and other features, aspects, and advantages of the scope will become better understood with regard to the following descriptions, claims, and accompanying drawings. It is to be noted, however, that the drawings illustrate only several embodiments and are therefore not to be considered limiting of the scope as it can admit to other equally effective embodiments.

Figure 1:
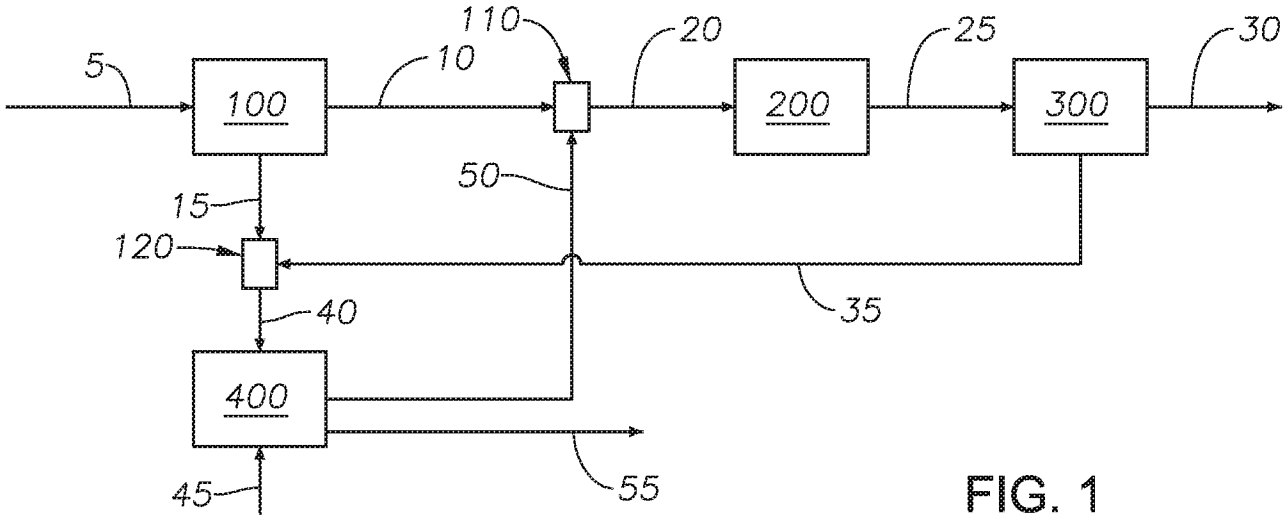
FIG. 1 provides a process diagram of an embodiment of the upgrading process.

In the accompanying Figures, similar components or features, or both, may have a similar reference label.

DETAILED DESCRIPTION

While the scope of the apparatus and method will be described with several embodiments, it is understood that one of ordinary skill in the relevant art will appreciate that many examples, variations and alterations to the apparatus and methods described here are within the scope and spirit of the embodiments.

Accordingly, the embodiments described are set forth without any loss of generality, and without imposing limitations, on the embodiments. Those of skill in the art understand that the scope includes all possible combinations and uses of particular features described in the specification.

The processes and systems described are directed to upgrading crude oil feedstocks. The process provides methods and apparatus for upgrading heavy fractions from a steam cracking process. The process provides methods and apparatus for producing light olefins. Advantageously, the upgrading processes described here can increase the overall efficiency of the steam cracking process by cracking heavy fractions, such as asphaltenes, before the heavy fractions are introduced to the steam cracking process, where such heavy fractions are not suitable for a steam cracking process. Advantageously, the upgrading process increases the overall efficiency of producing light olefins from a whole range crude oil. Advantageously, the upgrading processes described here increase the overall efficiency of the steam cracking process by upgrading the heavy fractions from the steam cracking process. The incorporation of a supercritical water process can upgrade the heavy fractions from the steam cracking process allowing the supercritical treated stream to be reintroduced to the steam cracker. Advantageously, the incorporation of a supercritical water process can increase the liquid yield compared to conventional thermal processes, because supercritical water processes suppress solid coke formation and gas formation. Advantageously, the incorporation of a supercritical water process can crack and depolymerize asphaltenes and reduce the stress on the hydrotreating unit to prevent severe deactivation in the hydrotreating unit, which can increase catalyst life cycle and reduce catalyst maintenance.

As used throughout, "external supply of hydrogen" refers to the addition of hydrogen to the feed to the reactor or to the reactor itself. For example, a reactor in the absence of an external supply of hydrogen means that the feed to the reactor and the reactor are in the absence of added hydrogen, gas ($H_2$) or liquid, such that no hydrogen (in the form $H_2$) is a feed or a part of a feed to the reactor.

As used throughout, "external supply of catalyst" refers to the addition of catalyst to the feed to the reactor or the presence of a catalyst in the reactor, such as a fixed bed catalyst in the reactor. For example, a reactor in the absence of an external supply of catalyst means no catalyst has been added to the feed to the reactor and the reactor does not contain a catalyst bed in the reactor.

As used throughout, "atmospheric fraction" or "atmospheric residue fraction" refers to the fraction of oil-containing streams having a T10% of 650 deg. F., such that 90% of the volume of hydrocarbons have boiling points greater than 650 deg. F. and includes the vacuum residue fraction. An atmospheric fraction can include distillates from an atmospheric distillation.

As used throughout, "vacuum fraction" or "vacuum residue fraction refers to the fraction of oil-containing streams having a T10% of 1050 deg. F.

As used throughout, "asphaltene" refers to the fraction of an oil-containing stream which is not soluble in a n-alkane, particularly, n-heptane.

As used throughout, "light hydrocarbons" refers to hydrocarbons with less than 9 carbon atoms ($C_{9-}$ hydrocarbons).

As used throughout, "heavy hydrocarbons" refers to hydrocarbons having 9 or more carbon atoms ($C_{9+}$).

As used throughout, "hydrogenation" refers to adding hydrogen to hydrocarbon compounds.

As used throughout, "coke" refers to the toluene insoluble material present in petroleum.

As used throughout, "cracking" refers to the breaking of hydrocarbons into smaller ones containing few carbon atoms due to the breaking of carbon-carbon bonds.

As used throughout, "heteroatoms" refers to sulfur, nitrogen, oxygen, and metals occurring alone or as heteroatom-hydrocarbon compounds.

As used throughout, "upgrade" means one or all of increasing API gravity, decreasing the amount of heteroatoms, decreasing the amount of asphaltene, decreasing the amount of the atmospheric fraction, increasing the amount of light fractions, decreasing the viscosity, and combinations of the same, in a process outlet stream relative to the process feed stream. One of skill in the art understands that upgrade can have a relative meaning such that a stream can be upgraded in comparison to another stream, but can still contain undesirable components such as heteroatoms.

As used throughout, "conversion reactions" refers to reactions that can upgrade a hydrocarbon stream including cracking, isomerization, alkylation, dimerization, aromatization, cyclization, desulfurization, denitrogenation, deasphalting, and demetallization.

As used throughout, "stable" or "stability" refers to the quality of the hydrocarbon and the ability of the hydrocarbon to resist degradation, oxidation, and contamination. Hydrocarbon stability is related to the amount of asphaltene and olefins, specially diolefins, present in the hydrocarbon. Increased amounts of asphaltene and olefins results in a less stable oil because asphaltenes and olefins are more susceptible to degradation, oxidation, and contamination. Stability is generally measured by ASTM 7060 for fuel oil and ASTM D381 for gasoline (gum formation). Stability includes storage stability.

As used throughout, "distillate" refers to hydrocarbons having a boiling point lower than 650 deg. F. Distillate can include the distillable materials from an atmospheric distillation process. Examples of hydrocarbons in the distillate can include naphtha, gasoline, kerosene, diesel, and combinations of the same.

The following embodiments, provided with reference to the figures, describe the upgrading process.

Referring to FIG. 1, a process flow diagram of an upgrading process is provided. Crude oil feed 5 is introduced to separator unit 100. Crude oil feed 5 can be any whole range crude oil containing hydrocarbons having an API gravity between about 15 and about 50, an atmospheric fraction between about 10 percent by volume (vol %) and about 60 vol %, a vacuum fraction between about 1 vol % and about 35 vol %, an asphaltene fraction between about 0.1 percent by weight (wt %) and about 15 wt %, and a total sulfur content between about 0.02 wt % and about 4 wt %. In at least one embodiment, crude oil feed 5 can have an API gravity between about 24 and about 49, an atmospheric fraction between about 20 vol % and about 57 vol %, a vacuum fraction between about 2.5 vol % and about 26 vol %, an asphaltene fraction between about 0.2 wt % and about 11 wt %, and a total sulfur content between about 0.05 wt % and about 3.6 wt %. In at least one embodiment, crude oil feed 5 has an API gravity between 23 and 27, an atmospheric fraction of less than about 24 vol %, and a total sulfur content of about 2.8 wt %.

Separator unit 100 can be any type of unit capable of fractionating a whole range crude oil into two or more streams based on a boiling point or boiling point range of those streams. Examples of separator unit 100 can include a distillation unit, a flashing column, and combinations of the same. The operating conditions of separator unit 100 can be selected based on the desired number and composition of the separated streams. The desired composition of the separated stream can be based on the operating unit downstream of separator unit 100. Separator unit 100 can separate crude oil feed 5 to produce light feed 10 and heavy feed 15.

Light feed 10 can contain hydrocarbons with boiling points of less than 650 deg. F. In at least one embodiment, light feed 10 is in the absence of asphaltene. The operating conditions of separator unit 100 can produce light feed 10 that has an increased amount of paraffins compared to crude oil feed 5, making light feed 10 suitable as a direct feed to a steam cracking process. Increased paraffins yields an increase in olefins in a steam cracking process. Advantageously, the reduced boiling points of light feed 10 reduces the tendency to form coke in a steam cracking process, compared to a fluid with greater boiling points.

Heavy feed 15 can contain hydrocarbons with a boiling point greater than 650 deg. F.

Light feed 10 can be introduced to light mixer 110. Light mixer 110 can be any type of mixing equipment capable of mixing two or more hydrocarbon streams. Light mixer 110 can include inline mixers, static mixers, mixing valves, and stirred tank mixers. Light feed 10 can be mixed with supercritical water process (SWP)-treated light product 50 in light mixer 110 to produce combined steam cracking feed 20.

Combined steam cracking feed 20 can be introduced to steam cracking process 200. Steam cracking process 200 can be any process capable of thermal cracking a hydrocarbon stream in the presence of steam. Steam can be used to dilute hydrocarbons for increasing olefin formation and reducing coke formation. Steam cracking process 200 can include cracking furnaces, cracking tubes, heat exchangers, compressors, refrigerating systems, gas separation units, and other steam cracking equipment. Steam cracking process 200 can include free radical reactions, which can be characterized by a large number of chain reactions.

Steam cracking process 200 can produce cracked product effluent 25. Cracked product effluent 25 can be introduced to fractionator unit 300.

Fractionator unit 300 can be any type of unit capable of fractionating cracked product effluent 25 into two or more streams. Examples of fractionator unit 300 can include distillation units, flashing columns, quenching units, dehydrating units, acid gas treatment, refrigerating units, and combinations of the same. The operating conditions of fractionator unit 300 can be selected based on the desired number and composition of the separated streams. In at least one embodiment, fractionator unit 300 can include a quenching unit, a dehydrating unit, and acid gas treatment to remove hydrogen sulfide and carbon dioxide, followed by a chiller unit, where the gases stream can be chilled to about −140 deg C. and −160 deg C. by a refrigerating unit to condense the alkene gases, which separates the alkene gases from the light gases. Fractionator unit 300 can separate cracked product effluent 25 to produce cracked light stream 30 and cracked residue stream 35.

Cracked light stream 30 can include light gases, alkene gases, light hydrocarbons, and combinations of the same. Light gases can include hydrogen, carbon monoxide, oxygen, and combinations of the same. The light gases can include between 80 mole percent (mol %) and 95 mol %. Alkene gases can include ethylene, propylene, butylene, and combinations of the same. The composition of cracked light stream 30 can depend on the composition of crude oil feed 5, the units included in the upgrading process, and the reactions occurring in each unit of the upgrading process. The hydrogen content in crude oil feed 5 can be between 0.1 wt % and 1 wt %. The carbon monoxide content in cracked product effluent 25 can be between 100 parts-per-million by weight (wt ppm) and 1,000 wt ppm.

Cracked light stream 30 can be used as a product stream, sent to storage, further processed, or blended in a downstream process. Further processing can include separating cracked light stream 30 to produce a purified ethylene stream, a purified propylene stream, a purified mixed ethylene and propylene stream, mixed butanes, and combinations of the same.

Cracked residue stream 35 can include hydrocarbons having a boiling point greater than 200 deg C. In at least one embodiment, cracked residue stream 35 includes olefins, aromatics, asphaltene, heteroatoms, and combinations of the same. Heteroatoms can include nitrogen compounds, vanadium, iron, chloride, oxygenates, non-hydrocarbon particulates, and combinations of the same. In at least one embodiment, cracked residue stream 35 can include hydrocarbons containing ten or more carbons (C10+ hydrocarbons). In at least one embodiment, cracked residue stream 35 includes pyrolysis fuel oil. Cracked residue stream 35 can be introduced to heavy mixer 120.

Heavy mixer 120 can be any type of mixing unit capable of mixing two or more hydrocarbon streams. Examples of heavy mixer 120 can include inline geometrical mixers, static mixers, mixing valves, and stirred tank mixers. Cracked residue stream 35 can be mixed with heavy feed 15 to produce combined supercritical process feed 40.

Combined supercritical process feed 40 can be introduced to supercritical water process 400 along water feed 45. Water feed 45 can be a demineralized water having a conductivity less than 1.0 microSiemens per centimeter (0/cm), alternately less 0.5 μS/cm, and alternately less than 0.1 μS/cm. In at least one embodiment, water feed 45 is demineralized water having a conductivity less than 0.1 μS/cm. Water feed 45 can have a sodium content less than 5 micrograms per liter (μg/L) and alternately less than 1 μg/L. Water feed 45 can have a chloride content less than 5 μg/L and alternately less than 1 μg/L. Water feed 45 can have a silica content less than 3 μg/L.

Cracked residue stream 35 can be unstable due to the presence of olefins and asphaltenes making it unsuitable as a fuel oil stream without removal of the olefins, including diolefins. Supercritical water process 400 can convert olefins and diolefins in combined supercritical water process feed 40 into aromatics and can remove asphaltenes. Advantageously, treating cracked residue stream 35 in supercritical water process 400 increases the yield of crude oil feed 5. Treating cracked residue stream 35 in supercritical water process 400 improves the stability of the hydrocarbons in SWP-treated heavy product 55 as compared to the hydrocarbons in cracked residue stream 35. Advantageously, treating cracked residue stream 35 converts low value hydrocarbons to higher value hydrocarbons increasing the overall value of the crude oil feed.

Supercritical water process 400 can be any type of hydrocarbon upgrading unit that facilitates reaction of hydrocarbons in the presence of supercritical water. Supercritical water process can include reactors, heat exchangers, pumps, separators, pressure control system, and other equipment. Supercritical water process 400 can include one or more reactors, where the reactors operate at a temperature between 380 deg C. and 450 deg C., a pressure between 22 MPa and 30 MPa, a residence time between 1 minute and 60 minutes, and a water to oil ratio between 1:10 and 1:0.1 vol/vol at standard ambient temperature and pressure. In at least one embodiment, supercritical water process 400 can be in the absence of an external supply of hydrogen. Supercritical water process 400 can be in the absence of an external supply of catalyst.

It is known in the art that hydrocarbon reactions in supercritical water upgrade heavy oil and crude oil containing sulfur compounds to produce products that have lighter fractions. Supercritical water has unique properties making it suitable for use as a petroleum reaction medium where the reaction objectives can include conversion reactions, desulfurization reactions denitrogenation reactions, and demetallization reactions. Supercritical water is water at a temperature at or greater than the critical temperature of water and at a pressure at or greater than the critical pressure of water. The critical temperature of water is 373.946° C. The critical pressure of water is 22.06 megapascals (MPa). Advantageously, at supercritical conditions water acts as both a hydrogen source and a solvent (diluent) in conversion reactions, desulfurization reactions and demetallization reactions and a catalyst is not needed. Hydrogen from the water molecules is transferred to the hydrocarbons through direct transfer or through indirect transfer, such as the water-gas shift reaction. In the water-gas shift reaction, carbon monoxide and water react to produce carbon dioxide and hydrogen. The hydrogen can be transferred to hydrocarbons in desulfurization reactions, demetallization reactions, denitrogenation reactions, and combinations of the same. The hydrogen can also reduce the olefin content. The production of an internal supply of hydrogen can reduce coke formation.

Without being bound to a particular theory, it is understood that the basic reaction mechanism of supercritical water mediated petroleum processes is the same as a free radical reaction mechanism. Radical reactions include initiation, propagation, and termination steps. With hydrocarbons, especially heavy molecules such as $C_{10+}$, initiation is the most difficult step and conversion in supercritical water can be limited due to the high activation energy required for initiation. Initiation requires the breaking of chemical bonds. The bond energy of carbon-carbon bonds is about 350 kJ/mol, while the bond energy of carbon-hydrogen is about 420 kJ/mol. Due to the chemical bond energies, carbon-carbon bonds and carbon-hydrogen bonds do not break easily at the temperatures in a supercritical water process, 380 deg C. to 450 deg C., without catalyst or radical initiators. In contrast, aliphatic carbon-sulfur bonds have a bond energy of about 250 kJ/mol. The aliphatic carbon-sulfur bond, such as in thiols, sulfide, and disulfides, has a lower bond energy than the aromatic carbon-sulfur bond.

Thermal energy creates radicals through chemical bond breakage. Supercritical water creates a "cage effect" by surrounding the radicals. The radicals surrounded by water molecules cannot react easily with each other, and thus, intermolecular reactions that contribute to coke formation are suppressed. The cage effect suppresses coke formation by limiting inter-radical reactions. Supercritical water, having low dielectric constant, dissolves hydrocarbons and surrounds radicals to prevent the inter-radical reaction, which is the termination reaction resulting in condensation (dimerization or polymerization). Because of the barrier set by the supercritical water cage, hydrocarbon radical transfer is more difficult in supercritical water as compared to conventional thermal cracking processes, such as delayed coker, where radicals travel freely without such barriers.

Sulfur compounds released from sulfur-containing molecules can be converted to $H_2S$, mercaptans, and elemental sulfur. Without being bound to a particular theory, it is believed that hydrogen sulfide is not "stopped" by the supercritical water cage due its small size and chemical structure similar to water ($H_2O$). Hydrogen sulfide can travel freely through the supercritical water cage to propagate radicals and distribute hydrogen. Hydrogen sulfide can lose its hydrogen due to hydrogen abstraction reactions with hydrocarbon radicals. The resulting hydrogen-sulfur (HS) radical is capable of abstracting hydrogen from hydrocarbons which will result in formation of more radicals. Thus, $H_2S$ in radical reactions acts as a transfer agent to transfer radicals and abstract/donate hydrogen.

Supercritical water process 400 can upgrade combined supercritical process feed 40 to produce SWP-treated light product 50 and SWP-treated heavy product 55. The amount of rejected feedstock is one of the parameters of the economics of a steam cracker.

SWP-treated light product 50 can contain hydrocarbons with a boiling point of less than 650 deg. F. Advantageously, SWP-treated light product 50 is suitable for processing in steam cracking process 200. SWP-treated light product 50 can be introduced to light mixer 110.

SWP-treated heavy product 55 can contain hydrocarbons with a boiling point of greater than 650 deg. F. The amount and composition of SWP-treated heavy product 55 depends on the feedstock and operation conditions. SWP-treated heavy product 55 can exhibit increased stability as compared to cracked residue stream 35 due to the reduce amounts of olefins, including diolefins, and asphaltenes. Cracked residue stream 35 can contain reduced amounts of sulfur and reduced amounts of polynuclear aromatics content as compared to SWP-treated heavy product 55. SWP-treated heavy product 55 can be introduced to the fuel oil tank or can be subjected to further processing. In at least one embodiment, SWP-treated heavy product 55 is further processed in a delayed coker.

Figure 2:
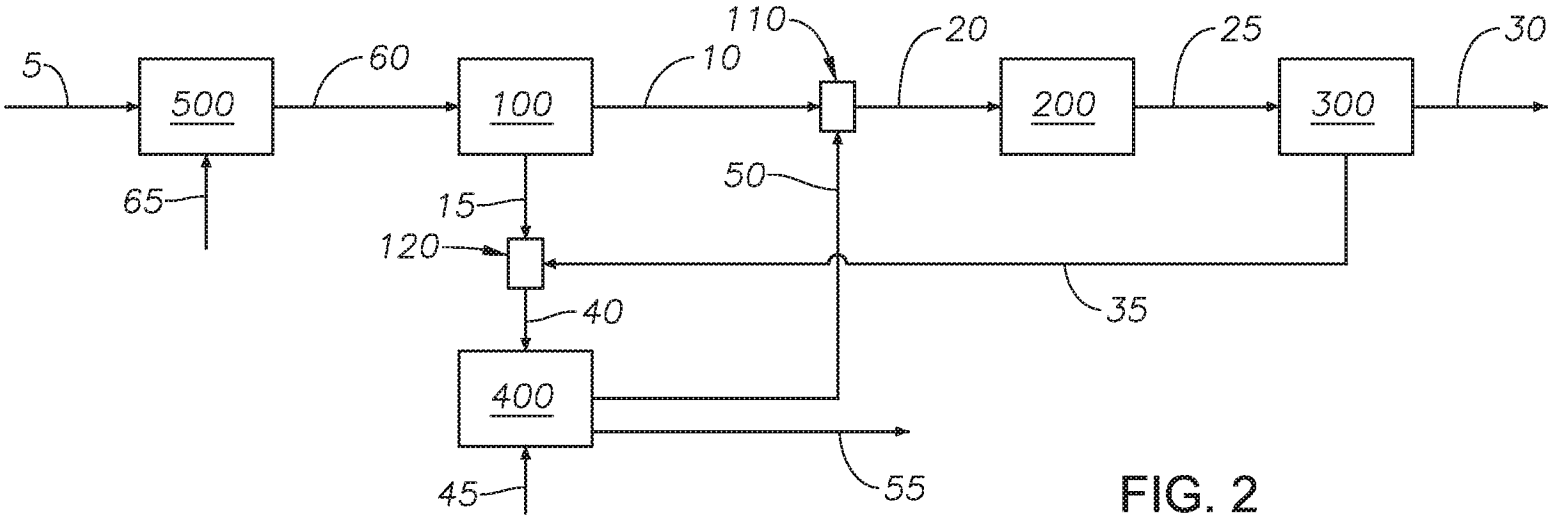
FIG. 2 provides a process diagram of an embodiment of the upgrading process.

Referring to FIG. 2, an embodiment of the upgrading process is described with reference to FIG. 1. Crude oil feed 5 is introduced to hydrogen addition process 500 along with hydrogen feed 65. Hydrogen feed 65 can be any external supply of hydrogen gas that can be introduced to hydrogen addition process 500. Hydrogen feed 65 can be sourced from a naphtha reforming unit, a methane reforming unit, a recycled hydrogen gas stream from hydrogen addition process 500, a recycled hydrogen gas stream from another refining unit, such as a hydrocracker, or any other source. The purity of hydrogen feed 65 can depend on the composition of crude oil feed 5 and the catalysts in hydrogen addition process 500.

Hydrogen addition process 500 can be any type of processing unit capable of facilitating the hydrogenation of crude oil in the presence of hydrogen gas. In at least one embodiment, hydrogen addition process 500 is a hydrotreating process. Hydrogen addition process 500 can include pumps, heaters, reactors, heat exchangers, a hydrogen feeding system, a product gas sweetening unit, and other equipment units included in a hydrotreating process. Hydrogen addition process 500 can include a hydrogenation catalyst. The hydrogenation catalyst can be designed to catalyze hydrotreating reactions. Hydrotreating reactions can include hydrogenation reactions, hydrogenative dissociation reactions, hydrocracking reactions, isomerization reactions, alkylation reactions, upgrading reactions, and combinations of the same. Hydrogenative dissociation reactions can remove heteroatoms. Hydrogenation reactions can product saturated hydrocarbons from aromatics and olefinic compounds. The upgrading reactions can include hydrodesulfurization reactions, hydrodemetallization reactions, hydrodenitrogenation reactions, hydrocracking reactions, hydroisomerization reactions, and combinations of the same. In at least one embodiment, the hydrotreating catalyst can be designed to catalyst a hydrogenation reaction in combination with upgrading reactions.

The catalyst can include transition metal sulfides supported on oxide supports. The transition metal sulfides can include cobalt, molybdenum, nickel, tungsten, and combinations of the same. The transition metal sulfides can include cobalt-molybdenum sulfide (CoMoS), nickel-molybdenum sulfide (NiMoS), nickel-tungsten sulfide (NiWS) and combinations of the same. The oxide support material can include alumina, silica, zeolites, and combinations of the same. The oxide support material can include gamma-alumina, amorphous silica-alumina, and alumina-zeolite. The oxide support material can include dopants, such as boron and phosphorus. The oxide support material can be selected based on the textural properties, such as surface area and pore size distribution, surface properties, such as acidity, and combinations of the same. For processing heavy crude oil, the pore size can be large, in the range of between 10 nm and 100 nm, to reduce or prevent pore plugging due to heavy molecules. The oxide support material can be porous to increase the surface area. The surface area of the oxide support material can be in the range of 100 $m^2/g$ and 1000 $m^2/g$ and alternately in the range of 150 $m^2/g$ and 400 $m^2/g$. The acidity of the catalyst can be controlled to prevent over cracking of the hydrocarbon molecules and reduce coking on the catalyst, while maintaining catalytic activity.

Hydrogen addition process 500 can include one or more reactors. The reactors can be arranged in series or in parallel. In at least one embodiment, hydrogen addition process 500 includes more than one reactor, where the reactors are arranged in series and the hydrogenation reaction and upgrading reactions are arranged in different reactors to maximize life of the catalyst in each reactor.

The arrangement of equipment within hydrogen addition process 500 and the operating conditions can be selected to maximize yield of liquid products. In at least one embodiment, hydrogen addition process 500 can be arranged and operated to maximize liquid yield in hydrogen-added stream 60. The hydrogen content and hydrogen to carbon ratio of hydrogen-added stream 60 can be greater than the hydrogen content and hydrogen to carbon ratio of crude oil feed 5. In at least one embodiment, hydrogen addition process 500 can be arranged and operated to reduce the amount of heteroatoms relative to crude oil feed 5 and increase the amount of distillate. Hydrogen-added stream 60 can be introduced to separator unit 100. Hydrogen-added stream 60 can include paraffins, naphthenes, aromatics, light gases, and combinations of the same. Light gases can include light hydrocarbons, hydrogen sulfide, and combinations of the same. In at least one embodiment, hydrogen-added stream 60 can include olefins present in an amount of less than 1 wt %.

Hydrogen-added stream 60 can be separated in separator unit 100 to produce light feed 10 and heavy feed 15, described with reference to FIG. 1.

Hydrogen addition process 500 can reduce the heavy fraction in hydrogen-added stream 60 relative to crude oil feed 5, but an atmospheric fraction can remain in hydrogen-added stream 60, including asphaltene. Combining hydrogen addition process 500 with separator unit 100 can remove the atmospheric fraction from hydrogen-added stream 60 to produce light feed 10, which can be introduced to steam cracking process 200. Advantageously, introducing heavy feed 15 to supercritical water process 400 can reduce the amount of the atmospheric fraction in heavy feed 15. Advantageously, SWP-treated light product 50 can be in the absence of an atmospheric fraction, which allows SWP-treated light product 50 to be recycled to steam cracking process 200, which increases the overall yield from steam cracking process 200 compared to a process that did not upgrade the heavy fractions from hydrogen addition process 500. Advantageously, supercritical water process 400 can reduce the amount of asphaltenes in heavy feed 15.

Figure 3:
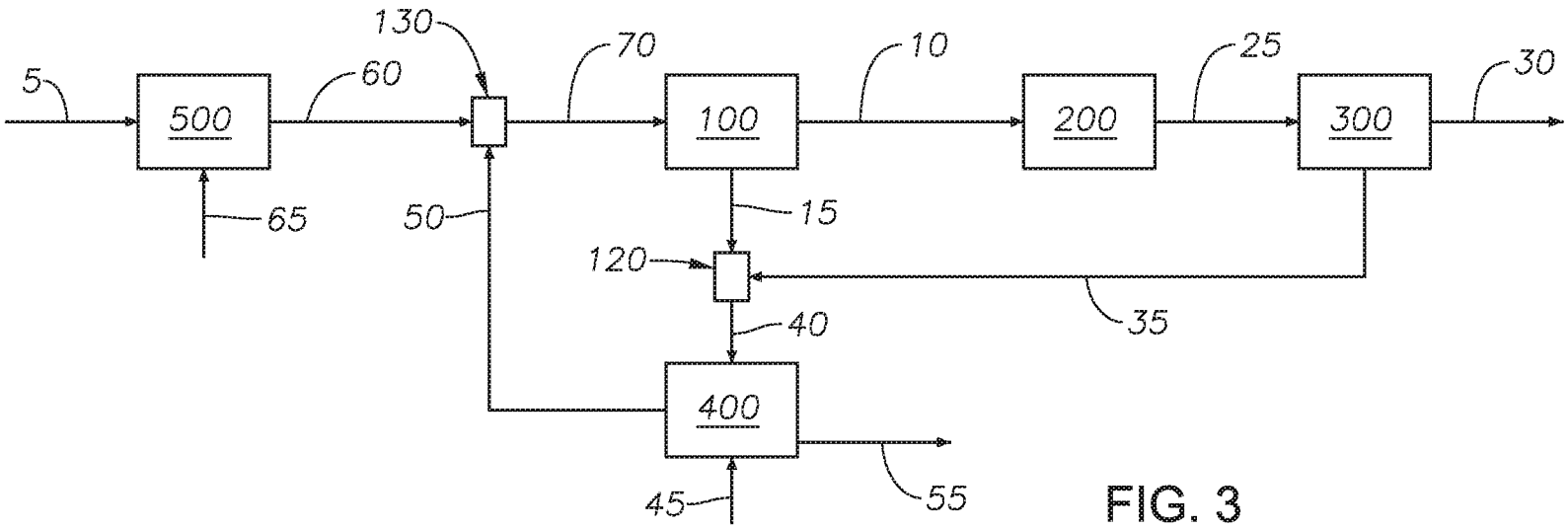
FIG. 3 provides a process diagram of an embodiment of the upgrading process.

Referring to FIG. 3, an alternate embodiment of the upgrading process is described with reference to FIG. 2. Hydrogen-added stream 60 is introduced to feed mixer 130. Feed mixer 130 can be any type of mixing unit capable of mixing two or more hydrocarbon streams. Examples of feed mixer 130 can include inline mixers, static mixers, mixing valves, and stirred tank mixers. Hydrogen-added stream 60 is mixed with SWP-treated light product 50 in feed mixer 130 to produce combined separator feed 70. Combined separator feed 70 is introduced to separator unit 100. Advantageously, the routing of SWP-treated light product 50 can allow the design of separators in supercritical water process 400 to minimize loss of valuable light fractions by using a wide boiling point range for SWP-treated light product 50.

Figure 4:
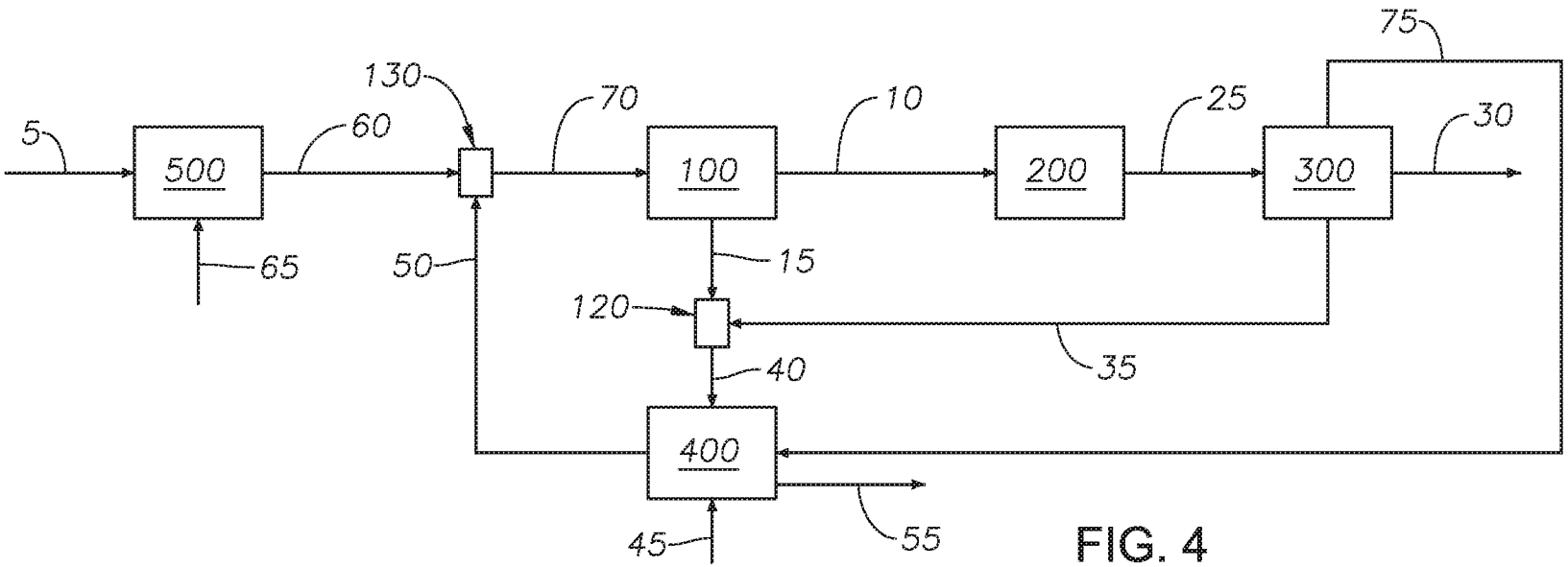
FIG. 4 provides a process diagram of an embodiment of the upgrading process.

Referring to FIG. 4, an alternate embodiment of the upgrading process is described with reference to FIG. 3. Fractionator unit 300 can separate light gases from cracked product effluent 25 to produce recovered hydrogen stream 75 in addition to cracked light stream 30 and cracked residue stream 35. Recovered hydrogen stream 75 can be introduced to supercritical water process 400. In at least one embodiment, recovered hydrogen stream 75 can be introduced to heavy mixer 40. Introducing recycled hydrogen to supercritical water process 400 can improve the reaction conditions in supercritical water process 400 by increasing reactions to saturate hydrocarbon radicals, inducing cracking of large molecules, suppressing hydrogen generation from dehydrogenation reactions, and increasing asphaltene conversion reactions, desulfurization reactions, and denitrogenation reactions. While described with reference to the embodiment shown in FIG. 4, one of skill will appreciate that recovered hydrogen stream 75 can be produced from fractionator unit 300 in each of the embodiments described herein and with reference to each of the embodiments captured in the figures.

Figure 5:
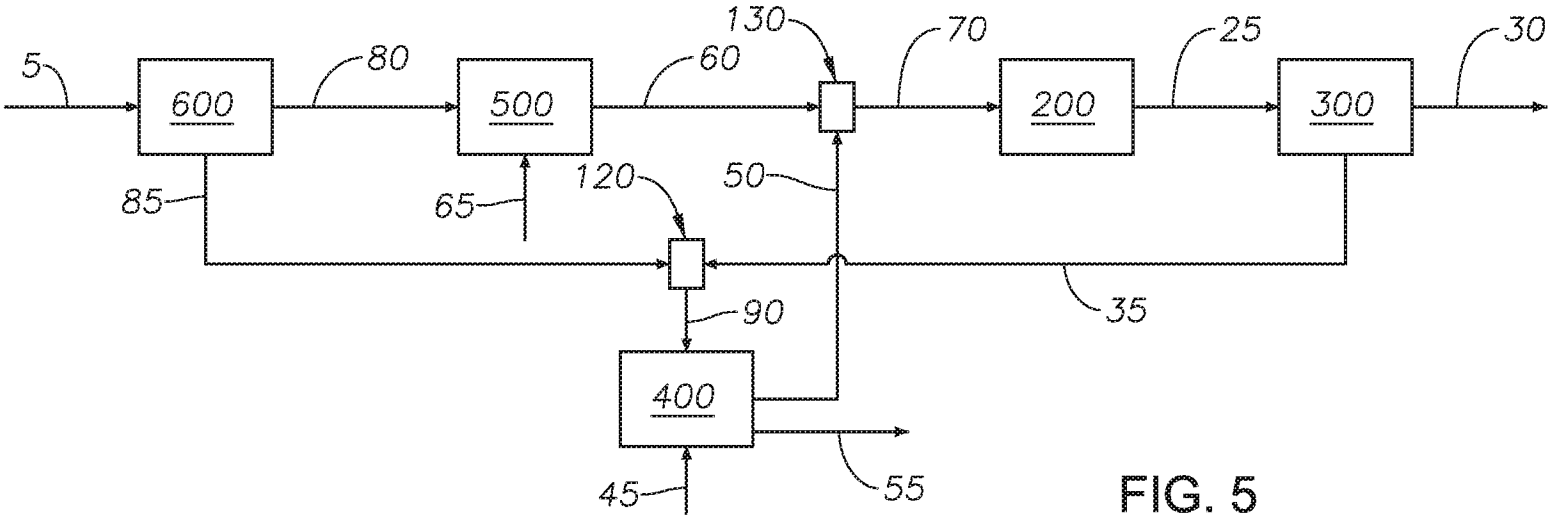
FIG. 5 provides a process diagram of an embodiment of the upgrading process.

Referring to FIG. 5, an alternate embodiment of the upgrading process is described with reference to FIG. 2 and FIG. 3. Crude oil feed 5 can be introduced to distillation unit 600. Distillation unit 600 can be any type of distillation tower capable of separating a hydrocarbon stream into one or more streams based on the boiling of the desired product streams. Distillation unit 600 can separate crude oil feed 5 into distillate stream 80 and distillation residue stream 85. Distillation residue stream 85 can include the hydrocarbons in crude oil feed 5 with a boiling point greater than 650 deg. F. Distillate stream 80 can include the hydrocarbons in crude oil feed 5 with a boiling point less than 650 deg. F. Distillate stream 80 can be introduced to hydrogen addition process 500. Hydrogen addition process 500 can add hydrogen to the hydrocarbons in distillate stream 80 to produce hydrogen-added stream 60. The hydrogen content and hydrogen to carbon ratio of hydrogen-added stream 60 can be greater than the hydrogen content and hydrogen to carbon ratio of distillate stream 80. Advantageously, separating distillation residue stream 85 and processing distillation reside stream 85 in supercritical water process 400 can remove high boiling compounds from being processed in hydrogen addition process 500, which can reduce the amount of hydrogen used in hydrogen addition process 500 and can prolong catalyst life in the same process. Overall, diverting high boiling point compounds from hydrogen addition process 500 improves the process economics due to reduced hydrogen consumption, reduce equipment footprint, and increased catalyst life. Hydrogen-added stream 60 can be introduced to feed mixer 130.

Combined separator feed 70 can be introduced to steam cracking process 200. Distillation residue stream 85 can be mixed with cracked residue stream 35 in heavy mixer 120 to produce combined residue stream 90. Combined residue stream 90 can be introduced to supercritical water process 400.

Figure 6:
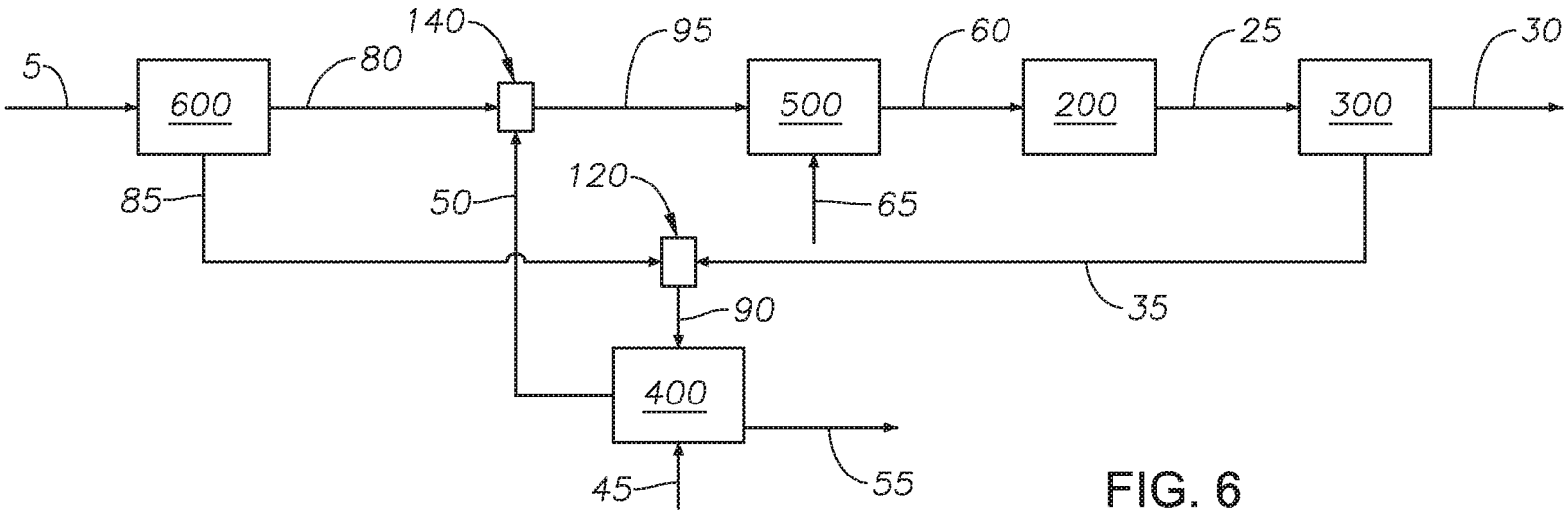
FIG. 6 provides a process diagram of an embodiment of the upgrading process.

Referring to FIG. 6, an alternate embodiment of the upgrading process is described with reference to FIG. 1, FIG. 2 and FIG. 5. Distillate stream 80 is mixed with SWP-treated light product 50 in distillate mixer 140 to produce combined distillate stream 95. Distillate mixer 140 can be any type of mixing unit capable of mixing two or more hydrocarbon streams. Examples of distillate mixer 140 can include inline mixers, static mixers, mixing valves, and stirred tank mixers. SWP-treated light product 50 can include an amount of olefins that can be saturated to paraffin by treatment in hydrogen addition process 500. Combined distillate stream 95 can be introduced to hydrogen addition process 500. Advantageously, the treatment of distillation residue stream 85 in supercritical water process can reduce the amount of asphaltenes, the amount of metals, and the amount of microcarbons in SWP-treated light product 50 compared to the amount in distillation residue stream 85, enabling a longer run length in hydrogen addition process 500 at sustained performance levels. Advantageously, introducing SWP-treated light product 50 to hydrogen addition process 500 can increase the olefin content of cracked product effluent 25, because the increased amount of paraffins in hydrogen-added stream 60 increases the olefin content in cracked product effluent 25. Advantageously, processing distillation residue stream 85 in supercritical water process 400 reduces the asphaltene content and converts large hydrocarbon molecules into smaller ones. Hydrogenation is better facilitated with smaller molecules, thus a greater amount of hydrogen can be added to the heavier fractions following treatment by supercritical water as compared to the embodiment in FIG. 5.

Figure 7:
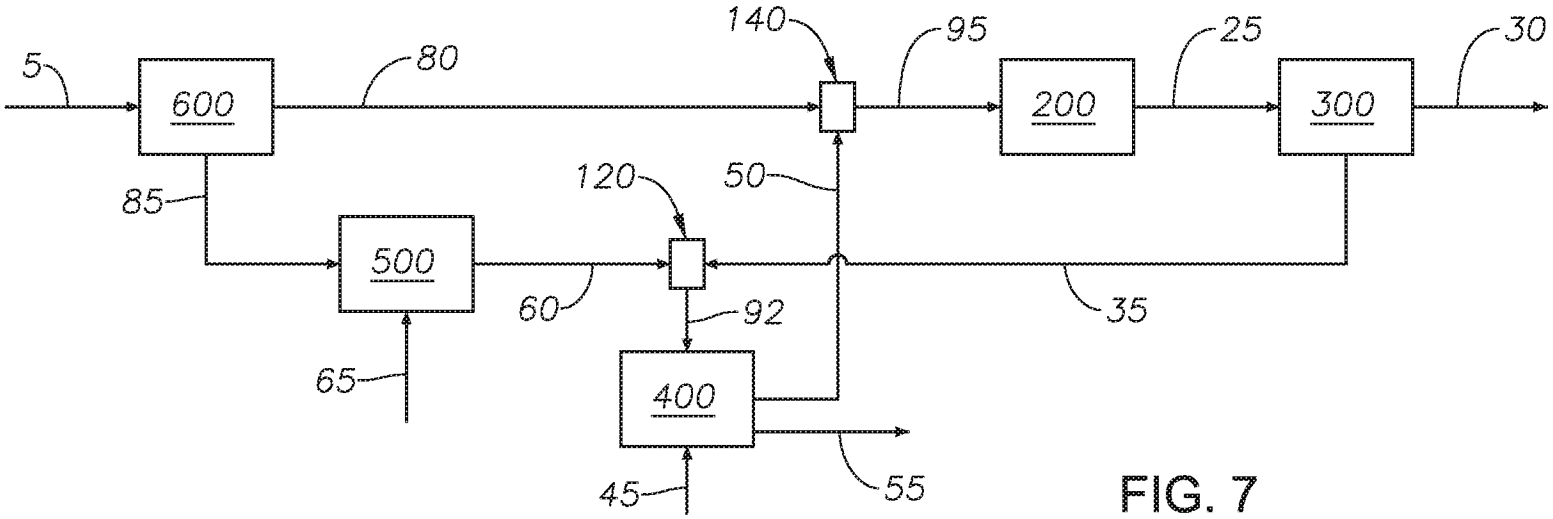
FIG. 7 provides a process diagram of an embodiment of the upgrading process.

Referring to FIG. 7, an embodiment of the upgrading process is provided, with reference to FIG. 1, FIG. 2, FIG. 5 and FIG. 6. Distillation residue stream 85 is introduced to hydrogen addition process 500 along with hydrogen feed 65. Hydrogen addition process 500 can produce hydrogen-added stream 60. Hydrogen-added stream 60 is described with reference to FIG. 2. Advantageously, processing hydrogen-added stream 60 in supercritical water process 400 can result in a greater amount of saturated hydrocarbons in SWP-treated light product 50 as compared to SWP-treated heavy product 55 due to the presence of hydrogen in hydrogen-added stream 60. As noted previously, the presence of hydrogen gas in supercritical water process 400 can increase the number of reactions to saturate hydrocarbon radicals, induce cracking of large molecules, and increase asphaltene conversion reactions, desulfurization reactions, and denitrogenation reactions. Hydrogen-added stream 60 can be mixed with cracked residue stream 35 in heavy mixer 120 to produce mixed stream 92. Mixed heavy stream 92 can be introduced to supercritical water process 400. Distillate stream 80 can be introduced to steam cracking process 200 as part of combined distillate stream 95 without undergoing further processing.

Figure 8:
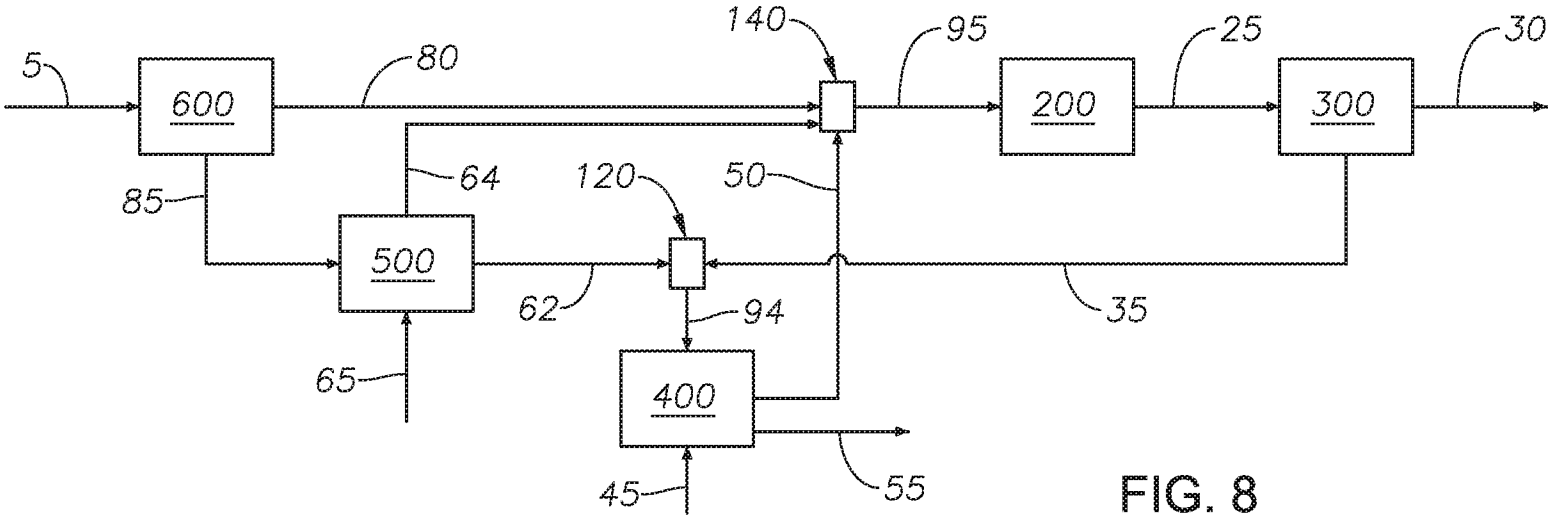
FIG. 8 provides a process diagram of an embodiment of the upgrading process.

Referring to FIG. 8, an embodiment of the upgrading process is described, with reference to FIG. 1, FIG. 2, FIG. 5, FIG. 6, and FIG. 7. Hydrogen addition process 500 can include equipment to separate the hydrogen-added stream to produce hydrogen-added heavy product 62 and hydrogen-added light product 64. Hydrogen-added light product 64 can be mixed with distillate stream 80 and SWP-treated light product 50 in distillate mixer 140 such that hydrogen-added light product is sent to steam cracking process 200 as part of combined distillate stream 95.

Hydrogen-added heavy product 62 is mixed with cracked residue stream 35 in heavy mixer 120 to produce mixed heavy stream 94.

Advantageously, the embodiments described here accommodate a wider range of feedstocks as crude oil feed 5 compared to a steam cracking process alone. In a process where a steam cracker is followed by a supercritical water process, the supercritical water process can treat the steam cracker effluent to remove sulfur, remove metals, reduce asphaltenes, and reduce viscosity. However, high viscosity oils cannot be processed directly in a steam cracker. Moreover, a feedstock directly introduced to a steam cracking process has a reduced liquid yield unless the feedstock has a high amount of olefins. In the upgrading process of the embodiments described here, the heavy fractions are separated and processed first in the supercritical water process, which can upgrade the heavy fractions to remove sulfur, remove metals, reduce asphaltenes, reduce viscosity and increase the amount of light olefins as compared to the heavy fraction. Thus, the upgrading process described here can handle high viscosity oils and can increase the fraction of light olefins in the feed to the steam cracker.

Additional equipment, such as storage tanks, can be used to contain the feeds to each unit. Instrumentation can be included on the process lines to measure various parameters, including temperatures, pressures, and concentration of water.

EXAMPLES

Figure 9:
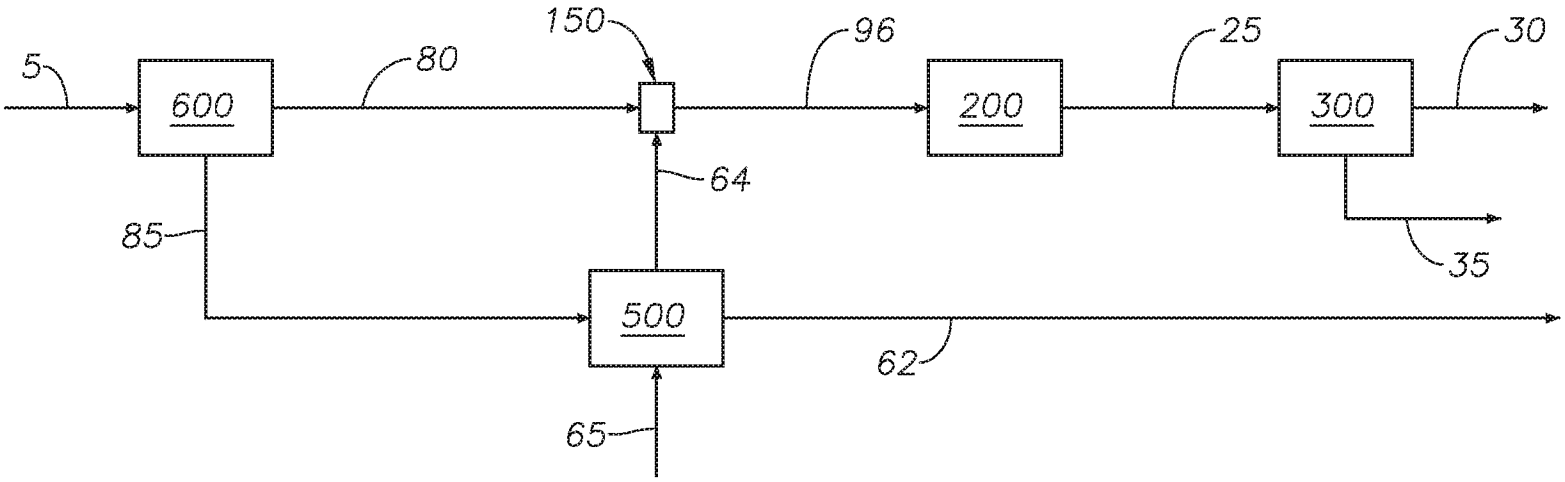
FIG. 9 provides a process diagram of a comparative system in the absence of a supercritical water process.

The Example is a comparative example comparing the comparative process embodied in FIG. 9 to the upgrading process embodied in FIG. 8. In the comparative process of FIG. 9, distillation residue stream 85 is introduced to hydrogen addition process 500. Hydrogen addition process 500 produces hydrogen-added heavy product 62 and hydrogen-added light product 64. Hydrogen-added light product 64 can be introduced to light distillate mixer 150 with distillate stream 80 to produce mixed steam cracking feed 96. Mixed steam cracking feed 96 can be introduced to steam cracking process 200. In both processes, an Arabian medium crude oil was used as crude oil feed 5, with an API gravity of 31 and a total sulfur content of 2.4 wt % sulfur.

Results are shown in Table 1.

TABLE 1

Properties of the Streams

| | Comparative (FIG. 9) | Upgrading Process (FIG. 8) | Ratio |
|---|---|---|---|
| Crude Oil Feeding Rate (MT/day) | 7062 | 7062 | 100% |
| Ethylene Production (MT/day) | 973 | 1157 | 119% |
| Propylene Production (MT/day) | 524 | 603 | 115% |
| Fuel Oil Production (MT/day) | 3828 | 2696 | 70% |

As can be seen by the results in Table 1, the upgrading process described here can produce more light olefins. For example, the upgrading process produced 19% more ethylene compared to the comparative process and 15% more propylene.

Although the present invention has been described in detail, it should be understood that various changes, substitutions, and alterations can be made hereupon without departing from the principle and scope of the invention. Accordingly, the scope of the present invention should be determined by the following claims and their appropriate legal equivalents.

There various elements described can be used in combination with all other elements described here unless otherwise indicated.

The singular forms "a", "an" and "the" include plural referents, unless the context clearly dictates otherwise.

Optional or optionally means that the subsequently described event or circumstances may or may not occur. The description includes instances where the event or circumstance occurs and instances where it does not occur.

Ranges may be expressed here as from about one particular value to about another particular value and are inclusive unless otherwise indicated. When such a range is expressed, it is to be understood that another embodiment is from the one particular value to the other particular value, along with all combinations within said range.

Throughout this application, where patents or publications are referenced, the disclosures of these references in their entireties are intended to be incorporated by reference into this application, in order to more fully describe the state of the art to which the invention pertains, except when these references contradict the statements made here.

As used here and in the appended claims, the words "comprise," "has," and "include" and all grammatical variations thereof are each intended to have an open, non-limiting meaning that does not exclude additional elements or steps.

That which is claimed is:

1. A method for producing alkene gases from a cracked product effluent, the method comprising the steps of:

introducing a crude oil feed and a hydrogen feed to a hydrogen addition process, the hydrogen addition process configured to facilitate hydrogenation of hydrocarbons in the crude oil feed, wherein the hydrogen addition process comprises a hydrogenation catalyst, wherein the hydrogenation catalyst is operable to catalyze hydrotreating reactions;

allowing the hydrocarbons in the crude oil feed to undergo the hydrotreating reactions in the hydrogen addition process to produce a hydrogen-added stream, wherein the hydrogen-added stream comprises paraffins, naphthenes, aromatics, light gases, and combinations of the same;

introducing the hydrogen-added stream to a separator unit, the separator unit configured to separate the hydrogen-added stream based on a boiling point;

separating the hydrogen-added stream in the separator unit to produce a light feed and a heavy feed, wherein the light feed comprises hydrocarbons with boiling points of less than 650 deg. F., wherein the heavy feed comprises hydrocarbons with boiling points of greater than 650 deg. F.;

introducing the light feed and a supercritical water process (SWP)-treated light product to a light mixer, wherein the SWP-treated light product comprises hydrocarbons with boiling points of less than 650 deg. F. such that the SWP-treated light product is in the absence of an atmospheric fraction;

mixing the light feed with the SWP-treated light product in the light mixer to produce a combined steam cracking feed;

introducing the combined steam cracking feed to a steam cracking process, the steam cracking process configured to thermally crack the combined steam cracking feed in the presence of steam;

allowing thermal cracking to occur in the steam cracking process to produce the cracked product effluent;

introducing the cracked product effluent to a fractionator unit, the fractionator unit configured to separate the cracked product effluent;

separating the cracked product effluent in the fractionator unit to produce a cracked light stream and a cracked residue stream, wherein the cracked light stream comprises the alkene gases, wherein the alkene gases are selected from the group consisting of ethylene, propylene, butylene, and combinations of the same;

introducing the cracked residue stream and the heavy feed to a heavy mixer;

mixing the cracked residue stream and the heavy feed in the heavy mixer to produce a combined supercritical process feed;

introducing the combined supercritical process feed and a water feed to a supercritical water process, the supercritical water process configured to upgrade the combined supercritical process feed; and upgrading the combined supercritical process feed in the supercritical water process to produce the supercritical water process (SWP)-treated light product and a SWP-treated heavy product, wherein the SWP-treated heavy product comprises reduced amounts of olefins and asphaltenes relative to the cracked residue stream such that the SWP-treated heavy product exhibits increased stability relative to the cracked residue stream.

2. The method of claim 1, wherein an API gravity of the crude oil feed is between 15 and 50, wherein an atmospheric fraction of the crude oil feed is between 10 vol % and 60 vol %, wherein a vacuum fraction of the crude oil feed is between 1 vol % and 35 vol %, wherein an asphaltene fraction of the crude oil feed is between 0.1 wt % and 15 wt %, and wherein a total sulfur content of the crude oil feed is between 2.5 vol % and 26 vol %.

3. The method of claim 1, wherein the hydrogenation catalyst comprises a transition metal sulfide supported on an oxide support, wherein the transition metal sulfide is selected from the group consisting of cobalt-molybdenum sulfide (CoMoS), nickel-molybdenum sulfide (NiMoS), nickel-tungsten sulfide (NiWS) and combinations of the same.

4. The method of claim 1, wherein the hydrotreating reactions are selected from the group consisting of hydrogenation reactions, hydrogenative dissociation reactions, hydrogenative cracking reactions, isomerization reactions, alkylation reactions, upgrading reactions, and combinations of the same.

5. The method of claim 1, wherein the cracked residue stream comprises hydrocarbons having a boiling point greater than 200 deg C.

6. A method for producing alkene gases from a cracked product effluent, the method comprising the steps of:

introducing a crude oil feed to a distillation unit, the distillation unit configured to separate the crude oil feed;

separating the crude oil feed in the distillation unit to produce a distillate stream and a distillate residue stream, wherein the distillate stream comprises hydrocarbons with boiling points less than 650 deg. F.;

introducing the distillate stream to a hydrogen addition process, the hydrogen addition process configured to facilitate hydrogenation of hydrocarbons in the distillate stream, wherein the hydrogen addition process comprises a hydrogenation catalyst, wherein the hydrogenation catalyst is operable to catalyze hydrotreating reactions;

allowing the hydrocarbons in the distillate stream to undergo the hydrotreating reactions in the hydrogen addition process to produce a hydrogen-added stream, wherein the hydrogen-added stream comprises paraffins, naphthenes, aromatics, light gases, and combinations of the same;

introducing the hydrogen-added stream and a supercritical water process (SWP)-treated light product to a feed mixer, wherein the SWP-treated light product comprises hydrocarbons with boiling points less than 650 deg. F.;

mixing the hydrogen-added stream with the SWP-treated light product in the feed mixer to produce a combined separator feed;

introducing the combined separator feed to a steam cracking process, the steam cracking process configured to thermally crack the combined separator feed in the presence of steam;

allowing thermal cracking to occur in the steam cracking process to produce the cracked product effluent introducing the cracked product effluent to a fractionator unit, the fractionator unit configured to separate the cracked product effluent;

separating the cracked product effluent in the fractionator unit to produce a cracked light stream and a cracked residue stream, wherein the cracked light stream comprises the alkene gases, wherein the alkene gases are selected from the group consisting of ethylene, propylene, butylene, and combinations of the same;

introducing the cracked residue stream and the distillate residue stream to a heavy mixer;

mixing the cracked residue stream and the distillate residue stream in the heavy mixer to produce a combined residue stream;

introducing the combined residue stream and a water feed to a supercritical water process, the supercritical water process configured to upgrade the combined residue stream; and upgrading the combined residue stream in the supercritical water process to produce the SWP-treated light product and a SWP-treated heavy product, wherein the SWP-treated heavy product comprises reduced amounts of olefins and asphaltenes relative to the cracked residue stream such that the SWP-treated heavy product exhibits increased stability relative to the cracked residue stream.

7. The method of claim 6, wherein an API gravity of the crude oil feed is between 15 and 50, wherein an atmospheric fraction of the crude oil feed is between 10 vol % and 60 vol %, wherein a vacuum fraction of the crude oil feed is between 1 vol % and 35 vol %, wherein an asphaltene fraction of the crude oil feed is between 0.1 wt % and 15 wt %, and wherein a total sulfur content of the crude oil feed is between 2.5 vol % and 26 vol %.

8. The method of claim 6, wherein the hydrogenation catalyst comprises a transition metal sulfide supported on an oxide support, wherein the transition metal sulfide is selected from the group consisting of cobalt-molybdenum sulfide (CoMoS), nickel-molybdenum sulfide (NiMoS), nickel-tungsten sulfide (NiWS) and combinations of the same.

9. The method of claim 6, wherein the hydrotreating reactions are selected from the group consisting of hydrogenation reactions, hydrogenative dissociation reactions, hydrogenative cracking reactions, isomerization reactions, alkylation reactions, upgrading reactions, and combinations of the same.

10. The method of claim 6, wherein the cracked residue stream comprises hydrocarbons having a boiling point greater than 200 deg C.

11. A method for producing alkene gases from a cracked product effluent, the method comprising the steps of:

introducing a crude oil feed to a distillation unit, the distillation unit configured to separate the crude oil feed;

separating the crude oil feed in the distillation unit to produce a distillate stream and a distillation residue stream, wherein the distillate stream comprises hydrocarbons with boiling points less than 650 deg. F.;

introducing the distillate stream and the SWP-treated light product to a distillate mixer;

mixing the distillate stream with the SWP-treated light product in the distillate mixer to produce a combined distillate stream;

introducing the combined distillate stream to the hydrogen addition process, the hydrogen addition process configured to facilitate hydrogenation of hydrocarbons in the combined distillate stream, wherein the hydrogen addition process comprises a hydrogenation catalyst, wherein the hydrogenation catalyst is operable to catalyze hydrotreating reactions;

allowing the hydrocarbons in the combined distillate stream to undergo the hydrotreating reactions in the hydrogen addition process to produce a hydrogen-added stream, wherein the hydrogen-added stream comprises paraffins, naphthenes, aromatics, light gases, and combinations of the same;

introducing the hydrogen-added stream to the steam cracking process, the steam cracking process configured to thermally crack the hydrogen-added stream in the presence of steam;

allowing thermal cracking to occur in the steam cracking process to produce the cracked product effluent;

introducing the cracked product effluent to a fractionator unit, the fractionator unit configured to separate the cracked product effluent;

separating the cracked product effluent in the fractionator to produce a cracked light stream and a cracked residue stream, wherein the cracked light stream comprises the alkene gases, wherein the alkene gases are selected from the group consisting of ethylene, propylene, butylene, and combinations of the same;

introducing the cracked residue stream and the distillate residue stream to a heavy mixer;

mixing the cracked residue stream and the distillate residue stream in the heavy mixer to produce a combined residue stream;

introducing the combined residue stream and a water feed to a supercritical water process, the supercritical water process configured to upgrade the combined residue stream; and upgrading the combined residue stream in the supercritical water process to produce the SWP-treated light product and a SWP-treated heavy product, wherein the SWP-treated heavy product comprises reduced amounts of olefins and asphaltenes relative to the cracked residue stream such that the SWP-treated heavy product exhibits increased stability relative to the cracked residue stream.

12. The method of claim 11, wherein an API gravity of the crude oil feed is between 15 and 50, wherein an atmospheric fraction of the crude oil feed is between 10 vol % and 60 vol %, wherein a vacuum fraction of the crude oil feed is between 1 vol % and 35 vol %, wherein an asphaltene fraction of the crude oil feed is between 0.1 wt % and 15 wt %, and wherein a total sulfur content of the crude oil feed is between 2.5 vol % and 26 vol %.

13. The method of claim 11, wherein the hydrogenation catalyst comprises a transition metal sulfide supported on an oxide support, wherein the transition metal sulfide is selected from the group consisting of cobalt-molybdenum sulfide (CoMoS), nickel-molybdenum sulfide (NiMoS), nickel-tungsten sulfide (NiWS) and combinations of the same.

14. The method of claim 11, wherein the hydrotreating reactions are selected from the group consisting of hydrogenation reactions, hydrogenative dissociation reactions, hydrogenative cracking reactions, isomerization reactions, alkylation reactions, upgrading reactions, and combinations of the same.

15. The method of claim 11, wherein the cracked residue stream comprises hydrocarbons having a boiling point greater than 200 deg C.

16. A method for producing alkene gases from a cracked product effluent, the method comprising the steps of:

introducing a crude oil feed and a hydrogen feed to a hydrogen addition process, the hydrogen addition process configured to facilitate hydrogenation of hydrocarbons in the crude oil feed, wherein the hydrogen addition process comprises a hydrogenation catalyst, wherein the hydrogenation catalyst is operable to catalyze hydrotreating reactions;

allowing the hydrocarbons in the crude oil feed to undergo the hydrotreating reactions in the hydrogen addition process to produce a hydrogen-added stream, wherein the hydrogen-added stream comprises paraffins, naphthenes, aromatics, light gases, and combinations of the same;

introducing the hydrogen-added stream and a supercritical water process (SWP)-treated light product to a feed mixer, wherein the SWP-treated light product comprises hydrocarbons;

mixing the hydrogen-added stream with the SWP-treated light product in the feed mixer to produce a combined separator feed;

introducing the combined separator feed to a separator unit, the separator unit configured to separate the combined separator feed;

separating the combined separator feed in the separator unit to produce a light feed and a heavy feed, wherein the light feed comprises hydrocarbons with boiling points of less than 650 deg. F., wherein the heavy feed comprises hydrocarbons with boiling points of greater than 650 deg. F.;

introducing the light feed to a steam cracking process, the steam cracking process configured to thermally crack the light feed in the presence of steam;

allowing thermal cracking to occur in the steam cracking process to produce the cracked product effluent;

introducing the cracked product effluent to a fractionator unit, the fractionator unit configured to separate the cracked product effluent;

separating the cracked product effluent in the fractionator unit to produce a cracked light stream and a cracked residue stream, wherein the cracked light stream comprises the alkene gases, wherein the alkene gases are selected from the group consisting of ethylene, propylene, butylene, and combinations of the same;

introducing the cracked residue stream and the heavy feed to a heavy mixer;

mixing the cracked residue stream and the heavy feed in the heavy mixer to produce a combined supercritical process feed;

introducing the combined supercritical process feed and a water feed to a supercritical water process, the supercritical water process configured to upgrade the combined supercritical process feed; and upgrading the combined supercritical process feed in the supercritical water process to produce the SWP-treated light product and a SWP-treated heavy product, wherein the SWP-treated heavy product comprises reduced amounts of olefins and asphaltenes relative to the cracked residue stream such that the SWP-treated heavy product exhibits increased stability relative to the cracked residue stream.

17. The method of claim 16, further comprising the steps of:

separating light gases from the cracked product effluent in the fractionator unit to produce a recovered hydrogen stream, wherein the recovered hydrogen stream comprises hydrogen; and introducing the recovered hydrogen stream to the heavy mixer, such that the combined supercritical process feed comprises hydrogen.

* * * * *